US006821301B2

(12) United States Patent
Azuse et al.

(10) Patent No.: US 6,821,301 B2
(45) Date of Patent: Nov. 23, 2004

(54) LUBRICANTS FOR ELASTIC FIBER

(75) Inventors: Ikunori Azuse, Kyoto (JP); Yoshiyuki Wakahara, Kyoto (JP)

(73) Assignee: Sanyo Chemical Industries, Ltd., Kyoto (JP)

( * ) Notice: Subject to any disclaimer, the term of this patent is extended or adjusted under 35 U.S.C. 154(b) by 227 days.

(21) Appl. No.: 10/070,448

(22) PCT Filed: Jul. 31, 2001

(86) PCT No.: PCT/JP01/06573

§ 371 (c)(1),
(2), (4) Date: Jul. 1, 2002

(87) PCT Pub. No.: WO02/10500

PCT Pub. Date: Feb. 7, 2002

(65) Prior Publication Data

US 2003/0024052 A1 Feb. 6, 2003

(30) Foreign Application Priority Data

Jul. 31, 2000 (JP) ..... 2000-230514
Oct. 31, 2000 (JP) ..... 2000-331809
Mar. 16, 2001 (JP) ..... 2001-76728

(51) Int. Cl.[7] ..... D06M 10/00
(52) U.S. Cl. ..... 8/115.51; 8/115.6; 8/115.55; 8/115.65; 8/901; 252/8.84
(58) Field of Search ..... 8/115.51, 115.6, 8/115.55, 115.65, 901; 252/8.84

(56) References Cited

FOREIGN PATENT DOCUMENTS

| | | |
|---|---|---|
| JP | 4-352878 | 12/1992 |
| JP | 9-49167 | 2/1997 |
| JP | 11-12949 | 1/1999 |
| JP | 7-310281 | 11/1999 |
| JP | 2000-80561 | 3/2000 |

*Primary Examiner*—Hoa Van Le
(74) *Attorney, Agent, or Firm*—Westerman, Hattori, Daniels & Adrian, LLP

(57) ABSTRACT

The present invention provides a spin finish for elastic fibers which comprises an amphoteric surfactant and/or a cationic surfactant as well as a base oil and has a surface tension thereof at 25 of 14 to 35 mN/m and a volume resistivity thereof at 20 of $1\times10^{7}$ to $1\times10^{13}$ Ω cm;

a spin finish for elastic fibers which comprises an ionic surfactant and a base oil and has a surface tension (S) thereof at 25° C. of 14 to 22.5 mN/m and a volume resistivity (ρ) thereof at 20° C. of $1\times10^{7}$ to $1\times10^{13}$ Ω cm, ρ and S satisfying the following relation [1];

$$\rho \leqq 1\times10^{(-2.4S+61)} \quad [1]$$

a spin finish for elastic fibers which comprises a quaternary ammonium salt of the specific composition, a base oil and a higher fatty acid ($C_{5-30}$) metal salt powder;

a method of treating an elastic fiber which comprises providing an elastic fiber with any of the above spin finish for elastic fibers in an amount of 0.1 to 12% by weight of said fiber;

and an elastic fiber which is obtained by the above treatment method.

16 Claims, No Drawings

LUBRICANTS FOR ELASTIC FIBER

TECHNICAL FIELD

The present invention relates to a spin finish for elastic fibers. More particularly, it relates to a spin finish for obtaining elastic fibers having excellent anti-tackiness properties and good antistatic properties.

BACKGROUND ART

With regard to the spin finish to be attached to elastic fibers in the process of spinning thereof, there have so far been proposed:

① a method comprising suspending a solid metallic soap as an anti-tackiness agent to thereby produce a mold release effect (Japanese Kokoku Publication Sho-41-286 and Japanese Kokoku Publication Sho-40-5557), a method comprising using a polyether-modified silicone which is a liquid substance at ordinary temperature (Japanese Kokoku Publication Sho-45-40719 and Japanese Kokai Publication Sho-48-19893), and so forth; and ② a method comprising adding, as an antistatic agent, a phosphate type anionic surfactant such as an alkyl phosphate metal salt (Japanese Kokoku Publication Sho-41-21956).

However, the methods mentioned above under ① have a problem in that even the addition of such an anti-tackiness agent is almost ineffective in reducing the volume resistivity. In the case of suspending a solid metallic soap, in particular, it is a problem that the spin finish is poor in storage stability. As for the method mentioned under ②, the compatibility between the antistatic agent and a base oil is poor and they attach to fibers only poorly; thus the problem is that no satisfactory antistatic effect can be obtained and the anti-tackiness property and antistatic property can never be produced simultaneously.

SUMMARY OF THE INVENTION

Accordingly, it is a primary object of the present invention to provide a spin finish for elastic fibers which is excellent in antistatic property and can effectively prevent elastic fibers from tacking with one another in the process of production of elastic fibers.

Another object is to provide a spin finish for elastic fibers which shows good storage stability when a solid metallic soap is suspended therein.

The present inventors made intensive investigations in an attempt to develop the spin finish of the type mentioned above and, as a result, have now completed the present invention.

The invention has five aspects, as mentioned below.

Invention According to the First Aspect

A spin finish for elastic fibers which comprises an amphoteric surfactant (A1) and/or a cationic surfactant (A2) as well as a base oil (B) and has a surface tension thereof at 25° C. of 14 to 35 mN/m and a volume resistivity thereof at 20° C. of $1\times10^{7}$ to $1\times10^{13}$ Ω·cm.

Invention According to the Second Aspect

A spin finish for elastic fibers which comprises an ionic surfactant (A) and a base oil (B) and has a surface tension (S) thereof at 25° C. of 14 to 22.5 mN/m and a volume resistivity (ρ) thereof at 20° C. of $1\times10^{7}$ to $1\times10^{13}$ Ω·cm, ρ and S satisfying the following relation [1]:

$$\rho \leqq 1\times10^{(-2.4S+61)} \quad [1]$$

Invention According to the Third Aspect

A spin finish for elastic fibers which comprises a quaternary ammonium salt (A2-11) represented by the following general formula (6), a base oil (B) and a higher fatty acid ($C_{5-30}$) metal salt powder (C):

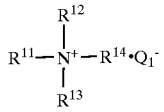

(6)

in the formula, $R^{11}$, $R^{12}$ and $R^{13}$ each independently is a group selected from among an alkyl, alkenyl, hydroxyalkyl and polyoxyalkylene group containing 1 to 30 carbon atoms and groups represented by the formula $R^5$—T—$R^6$— ($R^5$ represents the residue of a $C_{1-30}$ fatty acid after removal of the COOH group therefrom, $R^6$ represents an alkylene or hydroxyalkylene group containing 1 to 4 carbon atoms and T represents —COO— or —CONH—); $R^{14}$ is an alkyl, alkenyl, hydroxyalkyl or polyoxyalkylene group containing 1 to 30 carbon atoms; any two of $R^{12}$, $R^{13}$ and $R^{14}$, together with N, may combinedly form a heterocyclic ring; and $Q_1^-$ is an organic acid anion derived from an organic acid-modified silicone.

Invention According to the Fourth Aspect

A method of treating an elastic fiber which comprises providing an elastic fiber with any of the spin finish mentioned above in an amount of 0.1 to 12% by weight of said fiber.

Invention According to the Fifth Aspect

An elastic fiber which is obtainable by the above treatment method.

The surface tension (S: mN/m) of the spin finish at 25° C. and the volume resistivity (ρ: Ω·cm) of the spin finish at 20° C. are measured by the following methods.

Method of Measuring the Surface Tension of the Spin Finish at 25° C.

A 25-g of the spin finish sample conditioned at 25° C.±1° C. is weighed in a glass dish having an inside diameter of 80 mm and a depth of 15 mm and subjected to measurement on an automatic surface tensiometer (product of Kyowa Kaimen Kagaku; Wilhelmie method).

Method of Measuring the Volume Resistivity of the Spin Finish at 20° C.

The spin finish sample conditioned at 20° C.±1° C. is subjected to volume resistivity testing as described in the methods of testing of electrical insulation oils (JIS C 2101, para. 24, 1993) (the measurement temperature is 20° C.±1° C.).

In the following, the invention is described in detail.

DETAILED DISCLOSURE OF THE INVENTION

The spin finish according to the first aspect of the invention has a surface tension thereof at 25° C. of 14 to 35 mN/m (preferably 15 to 25 mN/m, more preferably 16 to 23 mN/m) and a volume resistivity thereof at 20° C. of $1\times10^{7}$ to $1\times10^{13}$ Ω·cm (preferably $5\times10^{7}$ to $5\times10^{12}$ Ω·cm, more preferably $1\times10^{8}$ to $1\times10^{12}$ Ω·cm).

When the surface tension exceeds 35 mN/m, the friction with various guides in processing processes increases and the incidence of yarn breaking may increase. If it is less than 14 mN/m, the spin finish will be scattered in increased amounts, whereby the working environment may be deteriorated in some instances.

When the volume resistivity exceeds $1\times10^{13}$ Ω·cm, the generation of static electricity increases in processing processes, in particular in the warping process, whereby the incidence of yarn breaking may increase. If it is less than $1\times10^{7}$ Ω·cm, it may become difficult to conduct the spin finish treatment uniformly.

The spin finish according to the second aspect of the invention satisfies the above relation [1] between the surface tension (S) thereof at 25° C. and the volume resistivity (ρ) thereof at 20° C. Further, S is 14 to 22.5 mN/m (preferably 16 to 21 mN/m, more preferably 17 to 20.5 mN/m) and ρ is $1\times10^{7}$ to $1\times10^{13}$ Ω·cm (preferably $5\times10^{7}$ to $5\times10^{12}$ Ω·cm, more preferably $1\times10^{8}$ to $1\times10^{12}$ Ω·cm).

When the surface tension is less than 14 mN/m, the spin finish will be scattered in increased amounts, whereby the working environment may be deteriorated in some instances. When it is not more than 22.5 mN/m, the friction with various guides in processing processes decreases and the incidence of yarn breaking lowers, in particular when an anionic surfactant alone is used as the ionic surfactant.

When the volume resistivity exceeds $1\times10^{13}$ Ω·cm, the generation of static electricity increases in processing processes, in particular in the warping process, whereby the incidence of yarn breaking may increase. If it is less than $1\times10^{7}$ Ω·cm, it may become difficult to conduct the spin finish treatment uniformly.

When the volume resistivity is not more than $1\times10^{(-2.4S+61)}$, good antistatic property and good anti-tackiness property can be produced simultaneously in particular when an anionic surfactant alone is used.

As the ionic surfactant (A) to be used in accordance with the second aspect of the invention, one or two or more species among amphoteric surfactants (A1) having none of perfluoro (cyclo) alkyl and perfluoroalkylene groups (hereinafter collectively referred to as "Rf groups"), cationic surfactants having none of Rf groups (A2) and anionic surfactants having none of Rf groups (A3) can be used. In the practice of the invention according to the first aspect, too, use is made of (A1) and/or (A2) and, if necessary, (A3) may be used.

Usable as the amphoteric surfactants (A1) are betaine type amphoteric surfactants (A1-1), amino acid type amphoteric surfactants (A1-2) and sulfonic acid salt type amphoteric surfactants (A1-3), etc., and there may be mentioned, for example, those described in U.S. Pat. No. 4,331,447 and U.S. Pat. No. 3,929,678.

Preferred among these amphoteric surfactants (A1) are, for example, those represented by the following general formula (1), (2) or (3) and mixtures of two or more of these.

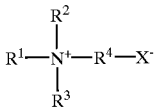

(1)

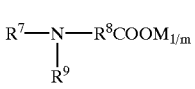

(2)

-continued

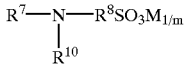

(3)

In the formulas, $R^1$, $R^2$ and $R^3$ each independently is a group selected from among an alkyl, alkenyl, hydroxyalkyl group containing 1 to 30 carbon atoms and groups represented by the formula $R^5$—T—$R^6$— ($R^5$ represents the residue of a $C_{1-30}$ fatty acid after removal of the COOH group therefrom, $R^6$ represents an alkylene or hydroxyalkylene group containing 1 to 4 carbon atoms and T represents —COO— or —CONH—); $R^4$ is an alkylene or hydroxyalkylene group containing 1 to 4 carbon atoms; $X^-$ is $COO^-$ or $SO_3^-$; $R^7$ is an alkyl, alkenyl or hydroxyalkyl group containing 1 to 30 carbon atoms; $R^8$ is an alkylene or hydroxyalkylene group containing 1 to 4 carbon atoms; $R^9$ is a hydrogen atom or a group represented by the formula —$R^8COOM_{1/m}$; $R^{10}$ is a hydrogen atom or an alkyl or alkenyl group containing 1 to 30 carbon atoms; M is a hydrogen atom or an alkali metal, alkaline earth metal or amine cation and, when M is a plurality of species, they may be the same or different; m represents the valence of M and is 1 or 2.

Referring to $R^1$, $R^2$, $R^3$, $R^7$ and $R^{10}$, the alkyl group containing 1 to 30 carbon atoms represented thereby may be straight or branched and includes methyl, ethyl, n- and i-propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl and 2-ethyldecyl and the like groups; the alkenyl group containing 2 to 30 carbon atoms represented thereby may be straight or branched and includes n- and i-propenyl, hexenyl, heptenyl, octenyl, decenyl, undecenyl, dodecenyl, tetradecenyl, pentadecenyl, hexadecenyl, heptadecenyl, octadecenyl, nonadecenyl and 2-ethyldecenyl and the like groups.

Referring to $R^1$, $R^2$, $R^3$ and $R^7$, the hydroxyalkyl group containing 1 to 30 carbon atoms represented thereby may be straight or branched and includes hydroxymethyl, hydroxyethyl, n- and i-hydroxypropyl, hydroxybutyl, hydroxyhexyl, hydroxyoctyl, hydroxydecyl, hydroxydodecyl, hydroxytetradecyl, hydroxyhexadecyl, hydroxyoctadecyl and the like groups.

Preferred among these are alkyl, alkenyl and hydroxyalkyl groups containing 6 to 24 carbon atoms and $R^5CONHR^6$— groups for $R^1$ and $R^7$, and alkyl, alkenyl and hydroxyalkyl groups containing 1 to 24 carbon atoms for $R^2$, $R^3$ and $R^{10}$.

The $C_{1-30}$ fatty acid which constitute the residue $R^5$ may be straight or branched and includes formic acid, acetic acid, propionic acid, butyric acid, isobutyric acid, valeric acid, caproic acid, enanthic acid, caprylic acid, pelargonic acid, lauric acid, myristic acid, stearic acid, isostearic acid, behenic acid 2-ethylhexanoic acid and the like. Preferred among these are $C_{6-24}$ fatty acids.

Referring to $R^4$, $R^6$ and $R^8$, the alkylene group containing 1 to 4 carbon atoms represented thereby may be straight or branched and includes methylene, ethylene, n- and i-propylene, butylene and the like groups; and the hydroxyalkylene group containing 1 to 4 carbon atoms represented thereby may be straight or branched and includes hydroxymethylene, hydroxyethylene, n- and i-hydroxypropylene, hydroxybutylene and the like groups.

Preferred among these are alkylene groups containing 1 to 4 carbon atoms for $R^6$ and alkylene groups containing 1 to 3 carbon atoms for $R^4$ and $R^8$.

Preferred among X is $COO^-$.

$R^9$ is a hydrogen atom or an $R^8COOM_{1/m}$ group. A mixture composed of a hydrogen atom as $R^9$ and an $R^8COOM_{1/m}$ group as $R^9$ is preferred among these.

Referring to M, the alkali metal includes lithium, potassium, sodium etc.; the alkaline earth metal includes calcium, magnesium, etc.; and the amine cation includes mono-, di- and tri-ethanolamine cations, 2-ethylhexylamine cation, etc. Among these, a hydrogen atom and alkali metals are preferred.

As the betaine type amphoteric surfactants (A1-1) represented by the general formula (1), there may be mentioned, for example, alkyl($C_{1-30}$)dimethylbetaines (stearyldimethylbetaine, lauryldimethylbetaine, etc.), alkyl ($C_{1-30}$)amidoalkyl($C_{1-4}$)dimethylbetaines (palm oil fatty acid amidopropyldimethylbetaine, lauramidopropyldimethylbetaine, stearamidopropyl-dimethylbetaine, etc.), alkyl($C_{1-30}$)dihydroxyalkyl($C_{1-30}$)-betaines (lauryldihydroxyethylbetaine etc.) and sulfobetaine type amphoteric surfactants (pentadecyldimethyltaurine etc.). Among these, alkyldimethylbetaines and alkylamidoalkyldimethylbetaines are preferred.

As the amino acid type amphoteric surfactants (A1-2) represented by the general formula (2), there may be mentioned, for example, alanine type [alkyl($C_{1-30}$) aminopropionic acid type, alkyl($C_{1-30}$)iminodipropionic acid type, etc.] amphoteric surfactants (sodium stearylaminopropionate, sodium β-laurylaminopropionate, sodium N-lauryl-β-iminodipropionate, potassium N-lauryl-β-iminodipropionate, etc.), glycine type [alkyl($C_{1-30}$) aminoaceticacid type, etc.] amphoteric surfactants (sodium laurylaminoacetate etc.). Preferred among these are alkylaminopropionic acid type amphoteric surfactants and alkyliminodipropionic acid type amphoteric surfactants.

As the sulfonic acid type amphoteric surfactants (aminosulfonic acid type amphoteric surfactants) (A1-3) represented by the general formula (3), there may be mentioned, for example, alkyl($C_{1-30}$)taurine type ($C_{15}H_{31}NHCH_2CH_2SO_3Na$, $C_{17}H_{35}NHCH_2CH_2CH_2SO_3Na$, etc.) amphoteric surfactants and so forth.

Preferred among these (A1) are (A1-1) and (A1-2).

As the cationic surfactants (A2) according to the first and second aspects of the invention, quaternary ammonium salt type cationic surfactants (A2-1), amine salt type cationic surfactants (A2-2) and so forth can be used and there may be mentioned, for example, those described in U.S. Pat. No. 4,331,447 and U.S. Pat. No. 3,929,678.

As (A2), there may be mentioned, for example, those represented by the following general formula (4) or (5) and mixtures of two or more of these.

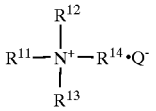

(4)

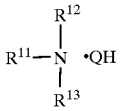

(5)

[In the formulas, $R^{11}$, $R^{12}$ and $R^{13}$ each independently represents a group selected from among an alkyl, alkenyl, hydroxyalkyl and polyoxyalkylene group containing 1 to 30 carbon atoms and groups represented by the formula $R^5$—T—$R^6$— ($R^5$ represents the residue of a $C_{1-30}$ fatty acid after removal of the COOH group therefrom, $R^6$ represents an alkylene or hydroxyalkylene group containing 1 to 4 carbon atoms and T represents —COO— or —CONH—); $R^{14}$ is an alkyl, alkenyl, hydroxyalkyl or polyoxyalkylene group containing 1 to 30 carbon atoms; any two of $R^{12}$, $R^{13}$ and $R^{14}$, together with N, may combinedly form a heterocyclic ring; $Q^-$ represents an inorganic or organic acid anion and QH represents an inorganic or organic acid.]

Referring to $R^{11}$, $R^{12}$ and $R^{13}$, the alkyl, alkenyl and hydroxyalkyl group containing 1 to 30 carbon atoms and the groups represented by the formula $R^5$—T—$R^6$— include the same ones as mentioned hereinabove referring to $R^1$, $R^2$ and $R^3$.

Referring to $R^{11}$, $R^{12}$ and $R^{13}$ the polyoxyalkylene group includes groups represented by the formula $R^{15}$—$(OA)_n$— ($R^{15}$ is a hydrogen atom or an alkyl group containing 1 to 4 carbon atoms, A is an alkylene group containing 2 to 4 carbon atoms and n is an integer of 2 to 15). As the $C_{2-4}$ alkylene group A, there may be mentioned 1,2-ethylene, 1,2- and 1,3-propylene, 1,2-, 2,3-, 1,3- and 1,4-butylene groups, etc. The $C_{1-4}$ alkyl group $R^{15}$ may be straight or branched and includes methyl, ethyl, n- and i-propyl, butyl and the like groups.

Among these, alkyl, alkenyl and hydroxyalkyl groups containing 1 to 24 carbon atoms are preferred as $R^{11}$, $R^{12}$ and $R^{13}$.

The alkyl, alkenyl, hydroxyalkyl or polyoxyalkylene group containing 1 to 30 carbon atoms represented by $R^{14}$ includes the same ones as mentioned hereinabove referring to $R^{11}$, $R^{12}$ and $R^{13}$. Preferred among these are alkyl and hydroxyalkyl groups containing 1 to 4 carbon atoms.

The acid QH which forms the anion $Q^-$ includes the followings:

(1) Inorganic Acids

Hydrohalic acids (hydrochloric acid, hydrobromic acid, hydroiodic acid, etc.), nitric acid, carbonic acid, phosphoric acid, etc.;

(2) Organic Acids:

(a) Alkyl sulfate esters $C_{1-4}$ alkyl sulfate esters such as methylsulfuric acid, ethylsulfuric acid and so forth;

(b) Alkyl phosphate esters

Mono- and/or di-$C_{1-8}$-alkyl phosphate esters such as dimethylphosphoric acid, diethylphosphoric acid and the like;

(c) $C_{1-30}$ aliphatic monocarboxylic acids

Saturated monocarboxylic acids (those mentioned as fatty acids the residue of which constitutes $R^5$, etc.);

Unsaturated monocarboxylic acids (acrylic acid, methacrylic acid, oleic acid, etc.);

Aliphatic hydroxycarboxylic acids (glycolic acid, lactic acid, hydroxybutyric acid, hydroxycaproic acid, ricinolic acid, hydroxystearic acid, gluconic acid, etc.);

(d) $C_{7-30}$ aromatic or heterocyclic monocarboxylic acids

Aromatic or heterocyclic monocarbocylic acids such as benzoic acid, cinnamic acid, naphthoic acid, pyrrolidonecarboxylic acid and the like;

Aromatic hydroxy carboxylic acids (salicylic acid, mandelic acid, etc.);

(e) Di- to tetra-basic polycarboxylic acids $C_{2-30}$ aliphatic polycarboxylic acids [saturated polycarboxylic acids (oxalic acid, malonic acid, succinic acid, glutaric acid, adipic acid, pimelic acid, suberic acid, azelaic acid, sebatic acid, etc.); $C_{4-30}$ unsaturated polycarboxylic acids (maleic acid, fumaric acid, itaconic acid, etc.)]; $C_{8-30}$ aromatic polycarboxylic acids

[phthalic acid, isophthalic acid, terephthalic acid, trimellitic acid, pyromellitic acid, etc.], etc.; sulfur-containing $C_{4-30}$ polycarboxylic acids (thiodipropionic acid etc.);

(f) $C_{2-30}$ amino acids

Amino acids such as aspartic acid, glutamic acid, cysteine, etc.;

(g) Organic acid-modified silicones

Organic acids resulting from substitution of an —$R^{27}$COOH— and/or —$R^{27}SO_3H$ group-containing group ($R^{27}$ represents an alkylene group of 2 to 5 carbon atoms) for some methyl groups of diorganopolysiloxanes, for example those represented by the general formula (7):

(7)

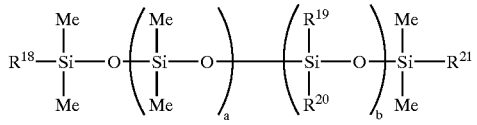

Referring to the general formula (7) representing (g), Me is a methyl group, at least one of $R^{18}$, $R^{19}$, $R^{20}$ and $R^{21}$ is an —$R^{27}$COOH— and/or —$R^{27}SO_3H$ group and the others may be methyl groups. a and b each is an integer of 1 to 10,000. The alkylene group of 2 to 5 carbon atoms may be straight or branched and includes ethylene, n- and i-propylene, butylene, hexylene and the like groups.

There may be mentioned, for example, carboxy-modified silicones having a viscosity at 25° C. of 5 to 20,000 $mm^2/s$ as determined on an Ubbellohde viscometer and a carboxy equivalent of 200 to 20,000.

(h) Carboxymethylated aliphatic alcohols ($C_{8-24}$)

Carboxymethylatedoctyl alcohol, carboxymethylated decyl alcohol, carboxymethylated lauryl alcohol, carboxymethylation product of Dobanol 23 (product of Mitsubishi Petrochemical), carboxymethylation product of Tridecanol (product of Kyowa Hakko Kogyo), etc.

(i) Carboxymethylated aliphatic alcohol ($C_{8-24}$)-ethylene oxide (hereinafter, abbreviated as EO) and/or -propylene oxide (hereinafter, abbreviated as PO) (1 to 20 moles) adducts Carboxymethylated octyl alcohol-EO (3 moles) adduct, carboxymethylated lauryl alcohol-EO (4 moles) adduct, carboxymethylated isostearyl alcohol-EO (3 moles) adduct, carboxymethylated Dobanol 23-EO (3 moles) adduct, carboxymethylated Tridecanol-EO (5 moles) adduct, etc.

Preferred among these are methylsulfuric acid, ethylsulfuric acid, adipic acid, gluconic acid, carboxymethylated lauryl alcohol-EO (2 to 5 moles) adducts, in particular isostearic acid and carboxy-modified silicones having a viscosity at 25° C. of 10 to 8,000 (more preferably 30 to 4,000, still more preferably 30 to 1,000) $mm^2/s$ and a carboxy equivalent of 300 to 8,000 (more preferably 500 to 4,000, still more preferably 500 to 1,500).

As the quaternary ammonium salt type cationic surfactants (A2-1) represented by the general formula (4), there may be mentioned, for example, alkyl($C_{1-30}$) trimethylammonium salts (lauryltrimethylammonium chloride, lauryltrimethylammonium isostearate, lauryltrimethylammonium salt of carboxy-modified silicone, etc.), dialkyl($C_{1-30}$)dimethylammonium salts (didecyldimethylammonium chloride, dioctyldimethylammonium bromide, didecyldimethylammonium isostearate, di(didecyldimethylammonium) adipate, didecyldimethylammonium salt of carboxy-modified silicone, etc.), nitrogen-containing ring-containing quaternary ammonium salts (cetylpyridinium chloride etc.), poly(number of moles added: 2 to 15)oxyalkylene ($C_{2-4}$) chain-containing quaternary ammonium salts [poly(number of moles added: 3)oxyethylenetrimethylammonium chloride etc.], alkyl($C_{1-30}$)amidoalkyl($C_{1-10}$)dialkyl($C_{1-4}$)-methylammonium salts (stearamidoethyldiethylmethylammonium methosulfate etc.), etc.

Preferred among these are alkyltrimethylammonium organic acid salts and, in particular, dialkyldimethylammonium organic acid salts.

Usable as the amine salt type cationic surfactants (A2-2) represented by the general formula (5) are those obtainable by neutralization of tertiary amines with inorganic acids (hydrochloric acid, nitric acid, sulfuric acid, hydroiodic acid, etc.) or organic acids (acetic acid, formic acid, oxalic acid, lactic acid, gluconic acid, adipic acid, alkylsulfuric acid, etc.). There may be mentioned, for example, inorganic acid salts or organic acid salts such as $C_{3-90}$ aliphatic tertiary amines (triethylamine, ethyldimethylamine, didecylmethylamine, N,N,N',N'-tetramethylethylenediamine, lauramidopropyldimethylamine, etc.), $C_{3-90}$ alicyclic (inclusive of nitrogen-containing heterocycles) tertiary amines (N-methylpyrrolidine, N-methylpiperidine, N-methylmorpholine, 4-dimethylaminopyridine, N-methylimidazole, 4,4'-dipyridyl, etc.), $C_{3-90}$ hydroxyalkyl group-containing tertiary amines (triethanolamine monostearate ester, N-stearamidoethyldiethanolamine, etc.) and the like.

Preferred among these are inorganic acid salts and organic acid salts of aliphatic amines.

Preferred among these (A2) are (A2-1).

Usable as the anionic surfactants (A3) in the practice of the second aspect of the invention (if necessary in the practice of the first aspect of the invention) are carboxylic acid salts (A3-1), sulfate ester salts (A3-2), salts of carboxymethylation products (A3-3), sulfonicacid salts (A3-4) and phosphate ester salts (A3-5), etc. Mention may be made, for example, of those described in U.S. Pat. Nos. 4,331,447 and 3,929,678.

As the carboxylic acid salts (A3-1), there may be mentioned $C_{8-22}$ saturated or unsaturated fatty acid salts and, specifically, there may be mentioned salts of the $C_{8-22}$ aliphatic carboxylic acids and aliphatic hydroxy carboxylic acids among those $C_{1-30}$ aliphatic monocarboxylic acids (c) mentioned hereinabove referring to the acid QH, which forms the anion $Q^-$ and of higher fatty acid mixtures obtainable by hydrolysis of palm oil, palm kernel oil, rice bran oil, beef tallow, etc.

As the salts, there maybe mentioned salts of alkali metals (sodium, potassium, etc.), ammonium, amines, for example mono-, di- and tri-alkanolamines ($C_{2-8}$; triethanolamine etc.), mono-, di- and tri-alkylamines ($C_{1-6}$; triethylamine etc.) and heterocyclic amines (morpholine etc.), etc. The same ones may also be used as the (A3) salts mentioned below.

As the sulfate ester salts (A3-2), there may be mentioned (A3-21) higher alcohol sulfate ester salts ($C_{8-18}$ aliphatic alcohol sulfate ester salts), (A3-22) higher alkyl ether sulfate ester salts [$C_{8-18}$ aliphatic alcohol-EO (1 to 10 moles) adduct sulfate salts], (A3-23) sulfated oils (products of sulfation of natural unsaturated fats and oils or unsaturated waxes as such, followed by neutralization), (A3-24) sulfated fatty acid esters [products of sulfation of lower alcohol ($C_{1-7}$) esters of unsaturated fatty acid ($C_{3-18}$), followed by neutralization] and (A3-25) sulfated olefins (products of sulfation of olefins containing 12 to 18 carbon atoms, followed by neutralization), and the like.

As specific examples of (A3-21), there may be mentioned octyl alcohol sulfate ester salts, decyl alcohol sulfate ester salts, lauryl alcohol sulfate ester salts, stearyl alcohol sulfate ester salts, sulfate ester salts of alcohols (e.g. ALFOL 1214: product of CONDEA) synthesized by using a Ziegler catalyst and sulfate ester salts of alcohols (e.g. Dobanol 23, 25 and 45: products of Mitsubishi Petrochemical; Tridecanol: product of Kyowa Hakko Kogyo; Oxocol 1213, 1215 and 1415: products of Nissan Chemical Industries; Diadol 115-L, 115H and 135: products of Mitsubishi Chemical) synthesized by the oxo process, etc.; specific examples of (A3-22) are lauryl alcohol-EO (2 moles) adduct sulfate ester salts and octyl alcohol-EO (3 moles) adduct sulfate ester salts, etc.; specific examples of (A3-23) are salts of sulfation products of castor oil, peanut oil, olive oil, rapeseed oil, beef tallow, mutton tallow and the like; specific examples of (A3-24) are salts of sulfation products of butyl oleate, butyl ricinolate and the like; and specific examples of (A3-25) are Teepol (product of Shell) and the like.

As the salts of carboxymethylation products (A3-3), there may be mentioned (A3-31) salts of carboxymethylation products of aliphatic alcohols ($C_{8-24}$) and (A3-32) salts of carboxymethylation products of aliphatic alcohol ($C_{8-24}$)-EO and/or -PO (1 to 20 moles) adducts, among others.

Specific examples of (A3-31) are carboxymethylated octyl alcohol sodium salt, carboxymethylated decyl alcohol sodium salt, carboxymethylated lauryl alcohol sodium salt, carboxymethylated Dobanol 23 sodium salt, carboxymethylated Tridecanol sodium salt, etc.; and specific examples of (A3-32) are carboxymethylated octyl alcohol-EO (3 moles) adduct sodium salt, carboxymethylated lauryl alcohol-EO (4 moles) adduct sodium salt, carboxymethylated isostearyl alcohol-EO (3 moles) adduct sodium salt, carboxymethylated Dobanol 23-EO (3 moles) adduct sodium salt, carboxymethylated Tridecanol-EO (5 moles) adduct sodium salt, etc.

As the sulfonic acid salts (A3-4), there may be mentioned (A3-41) alkyl($C_{8-24}$)benzenesulfonic acid salts, (A3-42) alkyl($C_{8-24}$)naphthalenesulfonic acid salts, (A3-43) sulfosuccinic acid diester type, (A3-44) α-olefinsulfonic acid salts and (A3-45) Igepon T type, etc.

Specific examples of (A3-41) are sodium dodecylbenzenesulfonate and the like; specific examples of (A3-42) are sodium dodecylnaphthalenesulfonate and the like; and specific examples of (A3-43) are di-2-ethylhexyl sulfosuccinate sodium salt and the like.

As the phosphate ester salts (A3-5), there may be mentioned (A3-51) higher alcohol ($C_{8-24}$) phosphate ester salts and (A3-52) higher alcohol ($C_{8-24}$)-EO adduct phosphate ester salts, and the like.

Specific examples of (A3-51) are disodium monolauryl phosphate, monosodium dilauryl phophate, etc.; and specific examples of (A3-52) are disodium oleyl alcohol-EO (5 moles) adduct phosphate and the like.

Preferred among these (A3) are (A3-3), (A3-4) and (A3-5). More preferred are (A3-3) and (A3-43).

The content of the amphoteric surfactant (A1) and/or cationic surfactant (A2) in the spin finish according to the first aspect of the invention is preferably 0.01 to 30% by weight, more preferably 0.05 to 20% by weight, still more preferably 0.1 to 10% by weight, based on the total spin finish (nonvolatile matter exclusive of the diluent and water to be mentioned later herein). At a content not lower than 0.01% by weight, it has a sufficient antistatic property and, at a content not higher than 30% by weight, the viscosity of the spin finish as a whole is within an appropriate range, hence such problems as yarn breaking hardly arises.

Preferred from the viewpoint of stability when formed as the spin finish, among (A1) and (A2), are (A2) and combination of (A1) and (A2). In the case of combined use, the weight ratio (A1)/(A2) can be varied within a wide range but preferably is 0/10 to 9/1, more preferably 1/9 to 7/3. In the practice of the first aspect of the invention, the content of (A3), which is used as an optional component, is preferably not more than 12% by weight, more preferably 0.1 to 10% by weight, based on the whole spin finish (nonvolatile matter).

In the spin finish according to the second aspect of the invention, in particular when a fluorine-containing lubricant (B1), which is to be mentioned later herein, is used as the base oil, (A3) and combination of (A3) and (A1) are preferred among (A1), (A2) and (A3).

In the case of combined use of (A3)/(A1), the weight ratio can be varied in a wide range but, from the viewpoint of stability when formed as the spin finish, it is preferably 10/0 or 9/1 to 5/5, more preferably 10/0.

The total content of (A) [(A1), (A2) and/or (A3)] in the spin finish according to the first and second aspects of the invention is preferably 0.01 to 30% by weight, more preferably 0.05 to 25% by weight, still more preferably 0.1 to 20% by weight, based on the whole spin finish (nonvolatile matter). At a content not lower than 0.01% by weight, it has a sufficient antistatic property and, at a content not higher than 30% by weight, the viscosity of the spin finish as a whole is within an appropriate range, hence such problems as yarn breaking hardly arises.

The base oil (B) constituting the spin finish according to the first and second aspects of the invention is not particularly restricted but includes, for example, one species or a mixture of two or more of species among fluorine-containing lubricants (B1), silicone lubricants (B2), hydrocarbon lubricants (B3), alcohol lubricants (B4), carboxylic acid lubricants (B5), carboxylic acid ester lubricants (B6) and polyether lubricants (B7).

Fluorine-containing Lubricant (B1)

Usable as (B1) in the practice of the invention are Rf group-containing compounds, for example. The Rf group includes straight or branched ones containing 2 to 20 carbon atoms (preferably 3 to 18, more preferably 6 to 14) [tetrafluoroethylene, hexafluoropropylene, perfluorohexyl, perfluorooctyl, perfluoroisooctyl, perfluorocetyl and perfluorooctadecylene groups, $(CF_3)_2CF$— group and groups represented by the following general formula (8), etc.], etc.

(8)

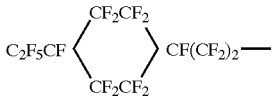

These can be synthesized by telomerization, electrolytic fluorination or oligomerization methods.

Among the Rf group-containing compounds, there are included polymers (B1-1), surfactants (B1-2) and other esters and/or amides (B1-3).

The fluorine content of said compounds is preferably 3 to 60% by weight, more preferably 4 to 50% by weight, still more preferably 5 to 40% by weight.

The (B1-1) contains an Rf group-containing monomer as an essential constituent unit and is obtainable by polymerizing said monomer (by vinyl polymerization, polycondensation, polyaddition, ring opening polymerization, etc.).

The weight average molecular weight of (B1-1) [as determined by gel permeation chromatography (hereinafter, abbreviated as GPC); (hereinafter, abbreviated as Mw)] is generally 400 to 500,000, preferably 450 to 100,000, more preferably 500 to 10,000. They may be oligomers with a Mw of not more than 1,000 or high-molecular-weight polymers.

Among (B1-1), the polymers resulting from vinyl polymerization are obtainable by homopolymerization of an Rf group-containing vinyl monomer or copolymerization thereof with another vinyl monomer. The vinyl polymerization can be carried out in the conventional manner.

As the Rf group-containing vinyl monomer, there may be mentioned, for example, fluorinated alkyl esters [perfluoro (cyclo)alkyl ethyl esters etc.] of ethylenically unsaturated carboxylic acids [(meth)acrylic acid, maleic acid, fumaric acid, itaconic acid, etc.], for example $C_8F_{17}CH_2CH_2OCOCH{=}CH_2$, $C_8F_{17}CH_2CH_2OCOC(CH_3){=}CH_2$ and $C_8F_{17}CH_2CH_2OCOCH{=}CHOCOCH_2CH_2C_8F_{17}$; N-alkyl($C_{1-12}$)perfluoro(cyclo)alkylsulfonamidoalkyl($C_{1-12}$)-polyoxyalkylene ($C_{2-4}$, polymerization degree 1 to 100) esters of ethylenically unsaturated carboxylic acids (same as above), for example $C_8F_{17}SO_2N(C_3H_7)(CH_2)_2(OC_2H_4)_5OCOCH{=}CH_2$; and fluorinated olefins ($C_{2-10}$; number of fluorine atoms 1 to 20), for example hexafluoropropylene, perfluorohexylethylene, etc.

The Rf group-containing vinyl monomer is used generally 5 to 100 mole percent, preferably 8 to 80 mole percent, more preferably 10 to 70 mole percent, based on the whole polymer.

Usable as the other vinyl monomers are alkyl (meth) acrylates [the alkyl group containing 1 to 30 carbon atoms; e.g. methyl methacrylate (hereinafter, abbreviated as MMA)]; and polyoxyalkylene mono- or poly-ol mono (meth)acrylates [mono(meth)acrylates of alkylene oxide adducts derived from monohydric or polyhydric alcohols mentioned below under (B6) or monohydric or polyhydric phenols mentioned below under (B7) can be used; as the alkylene oxide (hereinafter, abbreviated as AO), there may be mentioned those containing 2 to 4 carbon atoms, such as EO, PO, 1,2-, 2,3-, 1,3- and 1,4-butylene oxide (hereinafter, abbreviated as BO) and combined use of two or more of these (random and/or block addition); the number of moles to be added is 1 to 100, preferably 3 to 90, more preferably 5 to 80; as the AO adducts, there may be mentioned EO (1 to 100 moles) adducts derived from polypropylene glycol (hereinafter, abbreviated as PPG) having a Mw of 600 to 6,000, $C_{1-4}$-alkanol-EO and/or -PO (single, random or block) (1 to 100 moles) adducts, etc.]; $C_{2-30}$ vinylic hydrocarbons [aliphatic vinylic hydrocarbons (alkenes such as ethylene, propylene, octene and α-olefins other than those mentioned above; alkadienes such as butadiene, isoprene, etc.), alicyclic vinylic hydrocarbons (cyclohexene, cyclopentadiene, dicyclopentadiene, etc.), aromatic vinylic hydrocarbons (styrene, α-methylstyrene, divinylbenzene, etc.)]; $C_{3-30}$ carboxyl group-containing vinylic monomers [(meth)acrylic acid, maleic acid (anhydride), fumaric acid, monoalkyl esters of these, etc.]; $C_{2-30}$ sulfonic acid group-containing vinyl monomers and vinylic sulfate monoesters, and salts of these [vinylsulfonic acid, (meth)allylsulfonic acid, styrenesulfonic acid, sulfate esters of polyoxyalkylene polyol mono(meth)acrylates (same as above), and alkali metal salts (sodium salt, potassium salt, etc.), alkaline earth metal salts (calcium salt, magnesium salt, etc.), amine salts and ammonium salts of these, etc.]; $C_{3-30}$ hydroxyl group-containing vinyl monomers [hydroxyethyl (meth)acrylate, (meth)allyl alcohol, etc.]; $C_{3-30}$ amide group-containing vinyl monomers [(meth)acrylamide etc.]; $C_{5-30}$ epoxy group-containing vinyl monomers [glycidyl (meth)acrylate etc.]; $C_{4-30}$ vinyl esters (vinyl acetate etc.); $C_{3-30}$ vinyl ethers (vinylmethyl ether etc.); and $C_{4-30}$ vinyl ketones (vinyl methyl ketone etc.), etc.

As specific examples of the polymers obtainable by vinyl polymerization among (B1-1), there may be mentioned the following (1) to (6).

(1) A copolymer of $C_8F_{17}C_2H_4OH$ acrylate (50 mole percent), PPG (Mw=1,750)-EO (30 moles) adduct monoacrylate (25 mole percent) and methyl methacrylate (25 mole percent) (fluorine content=15% by weight, Mw=30,000);

(2) A copolymer of $C_8F_{17}C_2H_4OH$ acrylate (40 mole percent), butanol-PO (20 moles)-EO (12 moles) random adduct acrylate (40 mole percent) and MMA (20 mole percent) (fluorine content=14% by weight, Mw=18,600);

(3) A copolymer of $C_8F_{17}SO_2N(C_3H_7)C_2H_4OH$-EO (5 moles) adduct acrylate (40 mole percent), methanol-EO (15 moles) adduct acrylate (30 mole percent) and MMA (30 mole percent) (fluorine content=21% by weight, Mw=12,000);

(4) A copolymer of $C_8F_{17}C_2H_4OH$ acrylate (50 mole percent), butanol-EO (20 moles)-PO (15 moles) random adduct acrylate (30 mole percent) and MMA (20 mole percent) (fluorine content=18% by weight, Mw=150,000);

(5) A copolymer of $C_8F_{17}C_2H_4OH$ difumarate (25 mole percent), butanol-EO (20 moles)-PO (20 moles) random adduct acrylate (40 mole percent) and MMA (35 mole percent) (fluorine content=14% by weight, Mw=26,700); and (6) A copolymer of $C_8F_{17}C_2H_4OH$ acrylate (35 mole percent), butanol-EO (20 moles)-PO (15 moles) random adduct monofumarate (35 mole percent) and MMA (30 mole percent) (fluorine content=13% by weight, Mw=21,300).

As the polymers obtainable by polycondensation among (B1-1), there may be mentioned intramolecular ester linkage- and/or amide (or imide) linkage-containing species.

A method of synthesizing ester linkage-containing polymers includes, for example, subjecting a carboxylic acid component [mono- or poly-carboxylic acid or an ester-forming derivative thereof (lower alcohol ester, acid anhydride, etc.)] and an alcohol component (monohydric or polyhydric alcohol, polyether mono- or poly-ol) to direct esterification or trans-esterification while using an Rf group-containing carboxylic acid component and/or alcohol component as at least part of the respective components.

Usable as the Rf group-containing alcohol component are monohydric to hexahydric or more polyhydric alcohols and polyether mono- or poly-ols each having a Rf group containing 2 to 18 carbon atoms. Specific examples are monohydric alcohols, for example perfluoro(cyclo)alkyl($C_{2-18}$) alkanols($C_{1-12}$) such as $C_2F_5CH_2OH$, $C_4F_9CH_2CH_2OH$ and $C_8F_{17}CH_2CH_2OH$; N-alkyl($C_{1-12}$)-perfluoro(cyclo)alkyl ($C_{2-18}$)sulfonamido-alkanols ($C_{1-12}$) such as $C_8F_{17}SO_2N(C_3H_7)CH_2CH_2OH$; dihydric alcohols, for example perfluoro(cyclo)alkyl($C_{2-18}$)alkylene($C_{2-12}$) glycols such as $C_8F_{17}CH(OH)CH_2OH$ and $C_8F_{17}CH(OH)CH_2OH$; monoperfluoro(cyclo)alkyl ethers derived from polyhydric alcohols (mentioned below) such as $C_8F_{17}OCH_2CH(OH)CH_2OH$; and hydroxyl group-containing Rf compounds obtainable by reacting Rf group-containing epoxy compound [those mentioned below referring to polymers obtainable by ring opening polymerization among (B1-1)] and carboxylic acids [those mentioned below referring to (B6)]; as well as AO ($C_{2-4}$) adducts (the number of moles added 1 to 100) derived from these alcohols, etc.

As other alcohol components, there may be mentioned the following alcohols and polyether mono- or poly-ols.

Usable as the alcohols are aliphatic, aromatic and alicyclic alcohols containing 1 to 30 carbon atoms.

The aliphatic alcohols include straight and/or branched saturated monohydric alcohols [methanol, ethanol, n-propanol, butanol, pentyl alcohol, hexyl alcohol, heptyl alcohol, octyl alcohol, decyl alcohol, lauryl alcohol, myristyl alcohol, cetyl alcohol, stearyl alcohol, alcohols synthesized by using a Ziegler catalyst (e.g. ALFOL 1214 etc.), etc.; neopentyl alcohol, 2-ethylhexyl alcohol, isodecyl alcohol, isotridecyl alcohol, alcohols synthesized by the oxo process (e.g. Dobanol 23, 25, 45, Tridecanol, Oxocol 1213, 1215, 1415, Diadol 115-L, 115H, 135, etc.), secondary alcohols containing 12 or 14 carbon atoms, isocetyl alcohol, isostearyl alcohol, etc.]; straight and/or branched unsaturated monohydric alcohols (crotyl alcohol, oleyl alcohol, etc.; 3-octen-2-ol, 4-dodecen-3-ol, etc.); straight and/or branched saturated dihydric alcohols (ethylene glycol, propylene glycol, butylene glycol, hexylene glycol, octylene glycol, dodecylene glycol, etc.; 2,2-diethyl-1,3-butanediol etc.); straight and/or branched unsaturated dihydric alcohols (2-octene-1,4-diol, 4-dodecene-2,3-diol, etc.; 2-propyl-3-pentene-1,2-diol, 7-ethyl-4-octene-2,3-diol, etc.); trihydric to octahydric or more polyhydric alcohols (alkanepolyols such as glycerol, trimethylolpropane, pentaerythritol and sorbitol; intramolecular or intermolecular dehydration products derived therefrom such as glycerol dimer to hexamer, trimethylolpropane dimer to tetramer, pentaerythritol dimer to tetramer, sorbitan; as well as saccharides or glucosides, for example sucrose, fructose, methylglucosides, etc.), etc.

The aromatic alcohols include benzyl alcohol, α-phenylethyl alcohol, triphenylcarbinol, cinnamyl alcohol and the like.

The alicyclic alcohols include cyclobutanol, cyclohexanol, methylcyclohexyl alcohol, menthol, borneol and the like.

As the polyether mono- or poly-ols, there may be mentioned one or more of (co)polymers (polyether mono- or poly-ols) derived from compounds having 1 to 6 or more hydroxyl groups, for instance, by addition of 1 to 100 moles of one or more $C_{2-4}$ AOs.

As the compounds having one or more hydroxyl groups, there may be mentioned natural or synthetic aliphatic, aromatic and alicyclic alcohols containing 1 to 30 carbon atoms and phenols and the like.

As the aliphatic, aromatic and alicyclic alcohols, there may be mentioned those mentioned hereinabove.

As the phenols, there may be mentioned monohydric or polyhydric (dihydric or more than that) phenolic hydroxyl group-containing species, such as phenol, alkylphenols having a $C_{1-20}$ alkyl group (cresol, octylphenol, nonylphenol, dinonylphenol, etc.), bisphenols (bisphenol A, bisphenol F, bisphenols, etc.), monocyclicpolyhydricphenols (hydroquinone, catechol, etc.), condensed polycyclic phenols (naphthol etc.), etc.

The AO containing 2 to 4 carbon atoms includes EO, PO, 1,2-butylene oxide, BO, etc. In the case of copolymerization of two or more AOs, the mode of addition may be either random addition or block addition.

As specific examples of the polyether mono- or poly-ols, there may be mentioned, for example, butanol-(EO/PO) random adduct [EO/PO (weight ratio; the same is applied hereinafter)=50/50%, Mw=1,800], lauryl alcohol-(EO/PO) block adduct (EO/PO=40/60%, Mw=1,400), hexylene glycol-(EO/PO) random adduct (EO/PO=40/60%, Mw=4,000) and the like.

Usable as the Rf group-containing mono- or poly-carboxylic acid are monobasic, dibasic or more polybasic carboxylic acids having a Rf group containing 2 to 18 carbon atoms. Specifically, there may be mentioned perfluoro(cyclo)alkylcarboxylic acids such as $CF_3COOH$, $C_3F_7COOH$, $C_7F_{15}COOH$, $C_8F_{17}COOH$; perfluoro(cyclo)alkylsuccinic acids such as $C_8F_{17}CH(COOH)CH_2COOH$; and perfluoroalkylenediacetic acids such as $HOOCCH_2C_8F_{16}CH_2COOH$, and so forth.

As the other carboxylic acids, there may be mentioned those aliphatic and aromatic carboxylic acids mentioned later herein referring to (B6).

The ratio between the carboxylic acid component and the alcohol component, as expressed in terms of hydroxyl/carboxyl group equivalent ratio, is generally 0.6 to 1.6, preferably 0.7 to 1.5, more preferably 0.8 to 1.2.

The content of the Rf group-containing component is generally 5 to 100% by weight, preferably 10 to 80% by weight, more preferably 15 to 65% by weight, based on the whole polymer weight.

The amide (or imide) linkage-containing polymers can be produced by subjecting an Rf group-containing monocarboxylic acid, if necessary together with another mono- or poly-carboxylic acid (or the anhydride thereof), and a mono- and/or poly-amine to polycondensation; or subjecting a mono- or poly-carboxylic acid (or the anhydride thereof) and an Rf group-containing mono- or poly-amine, if necessary together with another mono- and/or poly-amine to polycondensation.

Usable as the Rf group-containing monocarboxylic acid are the same ones as mentioned hereinabove. As the other mono- or poly-carboxylic acid, there may be mentioned those mentioned later herein referring to (B6).

Usable as the Rf group-containing mono- or poly-amine are mono-, di- or tri-amines having a Rf group containing 2 to 18 carbon atoms. Specifically, there may be mentioned perfluoro(cyclo)alkyl($C_{2-18}$)alkyl($C_{1-12}$)amines such as $C_4F_9CH_2CH_2CH_2NH_2$ and $C_8F_{17}CH_2CH_2CH_2NH_2$; perfluoro(cyclo)alkyl($C_{2-18}$)alkyl($C_{1-12}$)aminoalkyl($C_{1-12}$)amines such as $C_8F_{17}CH_2CH_2CH_2NHCH_2CH_2CH_2NH_2$; perfluoro(cyclo)alkyl($C_{2-18}$)alkyl($C_{1-12}$)iminodi[alkyl($C_{1-12}$)-amines] such as $C_8F_{17}CH_2CH_2CH_2N(CH_2CH_2CH_2NH_2)_2$; perfluoro(cyclo)alkyl($C_{2-18}$)oxyalkyl($C_{1-12}$)amines such as $C_4F_9CH_2CH_2OCH_2CH_2CH_2NH_2$ and $C_8F_{17}CH_2CH_2OCH_2CH_2CH_2NH_2$; perfluoro(cyclo)alkyl($C_{2-18}$)oxyalkyl($C_{1-12}$)aminoalkyl($C_{1-12}$)-amines such as $C_8F_{17}CH_2CH_2OCH_2CH_2CH_2NHCH_2CH_2CH_2NH_2$; perfluoro(cyclo)alkyl($C_{2-18}$)oxyalkyl($C_{1-12}$)iminodi[alkyl($C_{1-12}$)amines] such as $C_8F_{17}CH_2CH_2OCH_2CH_2CH_2N(CH_2CH_2CH_2NH_2)_2$, and the like.

As the mono- or poly-amine, there may be mentioned amines having one, two or three or more primary and/or secondary amino groups, for example aliphatic amines [$C_{1-12}$ aliphatic alkylamines (ethylamine, propylamine, octylamine, laurylamine, etc.), $C_{2-12}$ alkylenediamines (ethylenediamine, propylenediamine, trimethylenediamine, tetramethylenediamine, hexamethylenediamine, etc.), polyalkylene ether (the alkylene group containing 2 to 4 carbon atoms, Mw=100 to 10,000) diamines {polyethylene glycol (hereinafter, abbreviated as PEG) (Mw=400) diaminopropyl ether, PPG (Mw=1,750)-EO (30 moles) adduct diaminopropyl ether, etc.}], $C_{6-20}$ alicyclic amines [cyclohexylamine, 1,3-diaminocyclohexane, isophoronediamine, menthanediamine, 4,4'-methylenedicyclohexanediamine (hydrogenated methylenedianiline), etc.], $C_{6-20}$ aromatic amines [phenylamine, 1,2-, 1,3- or 1,4-phenylenediamine, 2,4'- or 4,4'-diphenylmethanediamine, diaminodiphenyl sulfone, benzidine, thiodianiline, bis(3,4-diaminophenyl) sulfone, 2,6-diaminopyridine, m-aminobenzylamine, triphenyl-methane-4,4',4"-triamine, naphthylenediamine, etc.] and the like.

The ratio between the carboxylic acid and the amine, as expressed in terms of amino/carboxyl group equivalent ratio, is generally 0.6 to 1.6, preferably 0.7 to 1.5, more preferably 0.8 to 1.2.

The content of the Rf group-containing component is generally 5 to 100% by weight, preferably 10 to 80% by weight, more preferably 15 to 65% by weight, based on the whole polymer weight.

As specific examples of the polymers obtainable by polycondensation among (B1-1), there may be mentioned the following (1) to (9).

(1) A polyester from $C_8F_{17}COOH$ (30 mole percent), adipic acid (30 mole percent) and trimethylolpropane-PO (10 moles)-EO (10 moles) adduct (40 mole percent) (fluorine content=15% by weight, Mw=12,600);

(2) A polyester from trimellitic anhydride (24 mole percent), adipic acid (12 mole percent), $C_8F_{17}CH_2CH_2OH$ (29 mole percent) and hexylene glycol-PO (10 moles)-EO (12 moles) adduct (35 mole percent) (fluorine content=15% by weight, Mw=10,500);

(3) A polyesteramide from $C_8F_{17}COOH$ (28 mole percent), adipic acid (33 mole percent), trimethylolpropane-PO (10 moles)-EO (10 moles) adduct (28 mole percent) and octylamine (11 mole percent) (fluorine content=18% by weight, Mw=9,200);

(4) A polyester obtainable by transesterification reaction between trimethyl trimellitate (43 mole percent) and $C_8F_{17}CH_2CH_2OH$ (31 mole percent), PPG (Mw=1,700)-EO (16 moles) adduct (19 mole percent) and PEG with Mw=400 (19 mole percent) (fluorine content=14% by weight, Mw=12,500);

(5) A polyester obtainable by transesterification reaction between $C_8F_{17}CH_2CH_2OH$ (43 mole percent), dimethyl adipate (43 mole percent) and trimethylolpropane-PO (68 moles)-EO (10 moles) block adduct (14 mole percent) (fluorine content=16% by weight, Mw=6,200);

(6) A polyester obtainable by transesterification reaction between a hydroxyl group-containing Rf compound (17 mole percent) obtainable by reacting 1,2-diglycidylethane with $C_8F_{17}CO_2H$ in a mole ratio of 1:2, PPG (Mw=1,700)-EO (16 moles) adduct (17 mole percent), PEG with Mw=400 (17 mole percent) and dimethyl adipate (49 mole percent) (fluorine content=15% by weight, Mw=18,100);

(7) A polyester from $C_8F_{17}CH_2CH_2CH{=}CHCH(COOH)CH_2COOH$ (37.5 mole percent), PPG (Mw=1,700)-EO (16 moles) adduct (50 mole percent) and $C_8F_{17}CH_2CH_2OH$ (12.5 mole percent) (fluorine content=11% by weight, Mw=11,500);

(8) A polyester obtainable by transesterification reaction between $C_8F_{17}CH(OH)CH_2OH$ (25 mole percent), PPG (Mw=1,700)-EO (16 moles) adduct (15 mole percent), PEG with Mw=400 (10 mole percent) and dimethyl adipate (50 mole percent) (fluorine content=14% by weight, Mw=15,400);

(9) A polyester obtainable by transesterification reaction between a diester (16.7 mole percent) obtainable by reacting butanol-PO (15 moles)-EO (10 moles) block adduct glycidyl ether with adipic acid in a mole ratio of 2:1, $C_8F_{17}CH(OH)CH_2OH$ (33.3 mole percent) and dimethyl adipate (50 mole percent) (fluorine content=15% by weight, Mw=10,800).

As the polymers obtainable by polyaddition among (B1-1), there may be mentioned urethane type ones. The Rf group-containing urethane polymers can be produced by subjecting an Rf group-containing monohydric and/or polyhydric alcohol, if necessary together with another monohydric and/or polyhydric alcohol, and a mono- and/or poly-isocyanate to polyaddition or by subjecting a monohydric and/or polyhydric alcohol (containing an Rf group and/or free of any Rf group) and an Rf group-containing mono- and/or poly-isocyanate, if necessary together with another mono- and/or poly-isocyanate, to polyaddition.

Usable as the Rf group-containing monohydric or polyhydric alcohol and as the other monohydric or polyhydric alcohol are the same alcohol components as mentioned above referring to the polymers obtainable by polycondensation among (B1-1).

Usable as the mono- or poly-isocyanate are those mono-, di- or polyisocyanates which are conventionally used in the production of polyurethanes. Thus, there may be mentioned aromatic isocyanates containing 6 to 20 carbon atoms (exclusive of the carbon atom of the NCO; the same is applied hereinafter) [phenyl isocyanate, 1,3- or 1,4-phenylene diisocyanate, 2,4- or 2,6-tolylene diisocyanate (TDI), crude TDI, 2,4'- or 4,4'-diphenylmethanediisocyanate (MDI), crude MDI, 1,5-naphthylene diisocyanate, 4,4',4"-triphenylmethanetriisocyanate, m- or p-isocyanatophenylsulfonyl isocyanate, etc.], $C_{4-20}$ aliphatic isocyanates [ethyl isocyanate, ethylene diisocyanate, tetramethylenediisocyanate, hexamethylenediisocyanate (HDI), dodecamethylene diisocyanate, 1,6,11-undecanetriisocyanate, 2,2,4-trimethylhexamethylene diisocyanate, lysinediisocyanate, 2,6-diisocyanatomethyl caproate, bis(2-isocyanatoethyl) fumarate, bis(2-isocyanatoethyl) carbonate, 2-isocyanatoethyl-2,6-diisocyanatohexanoate, etc.], $C_{4-20}$ alicyclic isocyanates [cyclohexyl isocyanate, isophoronediisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5- or 2,6-norbornanediisocyanate, etc.], $C_{7-20}$ araliphatic polyisocyanates [benzyl isocyanate, m- or p-xylylene diisocyanate, $\alpha,\alpha,\alpha',\alpha'$-tetramethylxylylene diisocyanate, etc.], etc.

As the Rf group-containing polyisocyanates, there may be mentioned those fluorine-containing aliphatic polyisocyanates and fluorine-containing alicyclic polyisocyanates described in U.S. Pat. No. 4,994,542, for example 2,2,3,3,4,4,5,5-octafluorohexamethylene diisocyanate.

The ratio between the isocyanate and the alcohol, as expressed in terms of hydroxyl/isocyanato group equivalent ratio, is generally 0.6 to 1.6, preferably 0.7 to 1.5, more preferably 0.8 to 1.2.

The content of the Rf group-containing component is generally 5 to 100% by weight, preferably 10 to 80% by weight, more preferably 15 to 65% by weight, based on the whole polymer weight.

As specific examples of the polymers obtainable by polyaddition among (B1-1), there maybe mentioned the following (1) to (4).

(1) A polyurethane from $C_8F_{17}CH_2CH_2OH$ (27 mole percent), 4,4',4"-triphenylmethanetriisocyanate (27 mole percent), butanol-PO (20 moles)-EO (12 moles) adduct (27 mole percent) and PEG (Mw=600) (19 mole percent) (fluorine content=11% by weight, Mw=9,000);

(2) A polyurethane from $C_8F_{17}CH_2CH_2OH$ (22 mole percent), MDI (44 mole percent) and hexylene glycol-PO (10 moles)-EO (12 moles) adduct (34 mole percent) (fluorine content=12% by weight, Mw=5,600);

(3) A polyurethane from $C_8F_{17}CH_2CH_2OH$ (43 mole percent), IPDI (43 mole percent) and trimethylolpropane- PO (68 moles)-EO (10 moles) block adduct (14 mole percent) (fluorine content=15% by weight, Mw=6,600);

(4) A polyurethane from $C_8F_{17}CH_2CH_2OH$ (40 mole percent), IPDI (40 mole percent) and a polyester diol (20 mole percent) obtained by reacting PPG (Mw=1,700)-EO (16 moles) adduct with dimethyl adipate in a mole ratio of 7:6 (fluorine content=5% by weight, Mw=24,300).

The polymers obtainable by ring opening polymerization among (B1-1) can be produced by subjecting an Rf group-containing monohydric or polyhydric alcohol and an Rf group-containing and/or Rf group-free epoxide (preferably monoepoxide) to ring opening addition polymerization; or subjecting an Rf group-free monohydric or polyhydric alcohol and an Rf group-containing epoxide (preferably monoepoxide), if necessary together with an Rf group-free epoxide (preferably monoepoxide) to ring opening addition polymerization.

Usable as the Rf group-containing monohydric or polyhydric alcohol and as the Rf group-free monohydric or polyhydric alcohol are the same alcohol components as mentioned above referring to the polymers obtainable by polycondensation among (B1-1).

As the Rf group-containing epoxide, there maybe mentioned $C_{2-20}$ perfluoro AOs and AOs derived therefrom by substitution of hydrogen atoms for a part (1 to 10 atoms) of fluorine atoms within the molecule thereof, such as tetrafluoroEO, hexafluoroPO, octafluoroBO and perfluorooctadecylene oxide; Rf group-containing glycidyl ethers, for example perfluoro(cyclo)alkyl glycidyl ether and perfluoroalkylene diglycidyl ether; 1,2-bis[perfluoro(cyclo) alkyloxymethyl]EO, N-alkyl ($C_{1-4}$)-perfluoro(cyclo) alkylsulfonamidoalkyl($C_{1-12}$)EO, etc.

As the Rf group-free epoxide, there may be mentioned $C_{2-4}$ AOs (EO, PO, BO etc.) and glycidyl ethers [compounds obtainable by reacting monohydric alcohols ($C_{1-30}$) or AO (1-100 moles) adducts thereof with epichlorohydrin].

In the case of addition of two or more epoxides, the mode of addition thereof may be either random addition or block addition. The number of moles of the epoxide added is preferably 5 to 200.

As specific examples of the polymers obtainable by ring opening polymerization among (B1-1), there maybe mentioned the following (1) to (4).

(1) A ring opening polymerization product from PPG (Mw=1,200) (1.4 mole percent), EO (52.8 mole percent), PO (41.7 mole percent) and $C_8F17CH_2$-EO (4.1 mole percent) (fluorine content=16% by weight, Mw=6,000);

(2) A ring opening polymerization product from $C_8F_{17}CH_2CH_2OH$ (1.5 mole percent), EO (44.8 mole percent), PO (49.2 mole percent) and $C_8F_{17}CH_2$-EO (4.5 mole percent) (fluorine content=25% by weight, Mw=5,100);

(3) A ring opening polymerization product from EO (8 moles)-PO (50 moles)-EO (8 moles) block adduct (14.3 mole percent) and $C_8F_{17}CH_2CH_2$-glycidyl ether (85.7 mole percent) (fluorine content=29% by weight, Mw=6,700);

(4) A ring opening polymerization product from $C_8F_{17}CH_2CH_2OH$ (2.4 mole percent), EO (48.8 mole percent), PO (36.6 mole percent) and $C_8F_{17}CH_2CH_2$-glycidyl ether (12.2 mole percent) (fluorine content=34% by weight, Mw=4,800).

(B1-1) can be produced by the conventional methods of polymerization [bulk polymerization, solution polymerization, emulsion polymerization, suspension polymerization, one-step method, multistep method (prepolymer method), etc.], if necessary in the presence of a catalyst or other auxiliaries (e.g. polymerization initiator, chain transfer agent, etc. for vinyl polymerization, surfactant for emulsion or suspension polymerization), except for the use of an Rf group-containing monomer as at least part of the monomer composition.

As a specific method of production of (B1-1) and specific examples thereof, there may be mentioned those described in Japanese Kokoku Publication Sho-57-11670.

Usable as the Rf group-containing surfactants (B1-2) are compounds represented by the general formula Rf[(G)m-Z]n. In the formula, G is a divalent organic group, n is an integer of 1 [when Rf is a perfluoro(cyclo)alkyl group] or 2 [when Rf is a perfluoroalkylene group], m is an integer of 0, 1 or 2, at least one of the n Z groups is a hydrophilic group and, when n is 2, the other Z may be H.

As the hydrophilic group Z, there may be mentioned anionic groups, for example carboxylic acid (salt) groups: —COOM', sulfonic acid (salt) groups: —$SO_3M'$, sulfuric acid (salt) groups: —O—$SO_3M'$, phosphoric acid (salt) groups: —O—$PO(OM')_2$, $[>O—PO(OM')]_{1/2}$ [in the formulas, M' represents a cationic counter ion, for example H, an alkali or alkaline earth metalion (sodium, potassium, calcium, etc.), an ammonium, a primary to tertiary amine (mono-, di- or tri- alkyl containing 1 to 4 carbon atoms or alkanolamine containing 2 to 4 carbon atoms, etc.) cation or a quaternary ammonium (tetra-alkylammonium containing 1 to 4 carbon atoms, etc.) cation]; cationic groups, for example primary to tertiary amine (salt) groups and quaternary ammonium groups [cationic groups in the above general formula (4) and (5), respectively (residues after removal of the nonionic group $R^{11}$, $R^{12}$, $R^{13}$ or $R^{14}$)], primary to tertiary amino, aminoalkylamino and aminoalkylaminoalkylamino groups: —(NR-A)m—$NR_2$ [in the formula, R represents H and/or an alkyl group ($C_{1-4}$) and/or a hydroxyalkyl group ($C_{2-4}$), A represents an alkylene group ($C_{2-4}$) and m represents an integer of 0, 1 or 2]; hydrophilic (poly)oxyalkylene groups: —$(O—A)_p$—H (in the formula, A represents an alkylene group containing 2 to 4 carbon atoms and p is 1 to 50 or more), for example polyoxyethylene groups and copolymer (random and/or block) polyoxyalkylene groups mainly composed of oxyethylene groups (copolymerized oxyethylene-oxypropylene groups, etc.), and amine oxide groups, for example —$NR_2$—O [in the formula, R represents an alkyl group containing 1 to 4 carbon atoms and/or a hydroxyalkyl group containing 2 to 4 carbon atoms]; and combinations of these, for example amphoteric ionic groups such as betaine type amphoteric groups, amino acid type amphoteric groups and sulfonic acid type amphoteric groups [amphoteric groups in the above general formulas (1), (2) and (3) respectively (residues after removal of the nonionic group $R^1$, $R^2$, $R^3$, $R^7$, $R^9$ or $R^{10}$)] and the above anionic groups bound to apolyoxyalkylene group: —$(O-A)_p$-anionic group.

As the divalent organic group G, there may be mentioned alkylene groups ($C_{2-6}$), arylene groups, sulfonamidoalkylene ($C_{2-6}$) groups, N-alkyl($C_{1-6}$)-sulfonamidoalkylene ($C_{2-6}$) groups, carbonamidoalkylene ($C_{2-6}$) groups, N-alkyl ($C_{1-6}$)-carbonamido-alkylene ($C_{2-6}$) groups, —CF=CH—$CH_2$— groups and the like, each of which may optionally be substituted by an Rf group.

Included among such (B1-2) are those described in Japanese Kokoku Publication Sho-48-23161.

As specific examples of (B1-2), there may be mentioned the following anionic surfactants and nonionic surfactants.

The anionic surfactants include perfluoro(cyclo)-alkyl ($C_{4-30}$) sulfonic acid salts (alkali metal salts such as sodium salt and potassium salt, ammonium salts, etc.) [e.g. ammonium perfluorooctylsulfonate etc.] and perfluoro(cyclo)-alkyl($C_{4-30}$)carboxylic acid salts (alkali metal salts such as sodium salt and potassium salt, ammonium salts, etc.) [e.g. potassium perfluorooctanoate etc.].

The nonionic surfactants include (poly)oxyalkylene (alkylene group containing 2 to 5 carbon atoms; the degree of polymerization 1 to 50) perfluoro(cyclo)alkyl($C_{4-30}$) ethers [e.g. perfluorooctyl alcohol-EO (10 moles) adduct etc.].

The (B1-3) are Rf group-containing esters and/or amides other than the above-mentioned (B1-1) and (B1-2).

The Rf group-containing esters among (B1-3) are produced by the method comprising using, in carrying out the direct esterification or transesterification between a monocarboxylic acid component [a monocarboxylic acid or an ester-forming derivative thereof (lower alcohol ester, etc.)] and a monohydric alcohol component (monohydric alcohol, polyether monool), an Rf group-containing monocarboxylic acid component and/or the monohydric alcohol component.

As the Rf group-containing monocarboxylic acid, there may be mentioned the same ones as mentioned hereinabove referring to the polymers obtainable by polycondensation among (B1-1).

As the other monocarboxylic acid, there may be mentioned those aliphatic and aromatic monocarboxylic acids which are to be mentioned later herein referring to (B6).

As the Rf group-containing monohydric alcohol component and other monohydric alcohol component, there may be mentioned the same ones as mentioned hereinabove referring to the polymers obtainable by polycondensation among (B1-1).

The ratio between the monocarboxylic acid component and the monohydric alcohol component, as expressed in terms of hydroxyl/carboxyl group equivalent ratio, is generally 0.6 to 1.6, preferably 0.7 to 1.5, more preferably 0.8 to 1.2.

The content of the Rf group-containing component is generally 5 to 100% by weight, preferably 10 to 80% by weight, more preferably 15 to 65% by weight, based on the whole polymer weight.

Among (B1-3), the Rf group-containing amides are produced by the method using, in subjecting the monocarboxylic acid and monoamine to condensation, an Rf group-containing monocarboxylic acid and/or monoamine.

As the Rf group-containing monocarboxylic acid, there may be mentioned the same ones as mentioned hereinabove referring to the polymers obtainable by polycondensation among (B1-1).

As the other monocarboxylic acid, there may be mentioned those aliphatic and aromatic monocarboxylic acids which are to be mentioned later herein referring to (B6).

As the Rf group-containing monoamine and other monoamine, there may be mentioned the same ones as mentioned hereinabove referring to the polymers obtainable by polycondensation among (B1-1).

The ratio between the monocarboxylic acid and the monoamine, as expressed in terms of amino/carboxyl group equivalent ratio, is generally 0.6 to 1.6, preferably 0.7 to 1.5, more preferably 0.8 to 1.2.

The content of the Rf group-containing component is generally 5 to 100% by weight, preferably 10 to 80% by weight, more preferably 15 to 65% by weight, based on the whole polymer weight.

Preferred among these ($B_1$) are the polymers obtainable by polycondensation and vinyl polymerization among (B1-1) and the esters among (B1-3).

(B2) Silicone lubricant

As (B2), there may be mentioned, for example, the following (B2-1) to (B2-7) each represented by the general formula (7).

In the general formula (7) representing (B2), Me is a methyl group and a, b, $R^{18}$, $R^{19}$, $R^{20}$ and $R^{21}$ are as defined below.

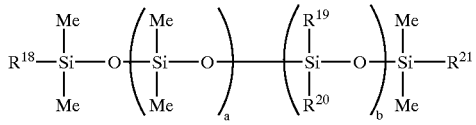

(7)

(B2-1) Polydimethylsiloxane, methylphenylpolysiloxane

In these, $R^{18}$, $R^{19}$, $R^{20}$ and $R^{21}$ in the general formula (7) each independently is a methyl group or a phenyl group (The case in which each of them is a methyl group reflects polydimethylsiloxane.). a and b each is an integer of 1 to 20,000.

(B2-2) Fluorine-modified silicones

In these, at least one of $R^{18}$, $R^{19}$, $R^{20}$ and $R^{21}$ is an Rf group-containing group. Each remaining group may be a methyl group, an alkyl group containing 2 to 20 carbon atoms, a phenyl group or an alkoxy group containing 1 to 5 carbon atoms. a and b each is an integer of 1 to 10,000.

As the Rf group, there may be mentioned those mentioned referring to (B1).

(B2-3) Alkyl-modified silicones

In these, at least one of $R^{18}$, $R^{19}$, $R^{20}$ and $R^{21}$ is an alkyl group containing 2 to 20 carbon atoms or a —($CH_2$)t-Ph group (Ph represents a phenyl group and t represents an integer of 1 to 4). Each remaining group may be a methyl group. a and b each is an integer of 1 to 10,000.

(B2-4) Epoxy-modified silicones

In these, at least one of $R^{18}$, $R^{19}$, $R^{20}$ and $R^{21}$ is an epoxy group-containing group. Each remaining group may be a methyl group, an alkyl group containing 2 to 20 carbon atoms, a phenyl group or an alkoxy group containing 1 to 5 carbon atoms. a and b each is an integer of 1 to 1,000.

The epoxy group-containing group includes groups represented by the following general formula (9) (in the formula, $R^{22}$ and $R^{28}$ each is an alkylene group containing 1 to 4 carbon atoms and k is 0 or 1), for example glycidyl, γ-glycidoxypropyl, and the like groups.

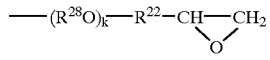

(9)

(B2-5) Alcohol- and/or polyether-modified ilicones

In these, at least one of $R^{18}$, $R^{19}$, $R^{20}$ and $R^{21}$ is a polyoxyalkylene chain-containing group. Each remaining group may be a methyl group, an alkyl group containing 2 to 20 carbon atoms, a phenyl group or an alkoxy group containing 1 to 5 carbon atoms. As the polyoxyalkylene chain-containing group, there may be mentioned groups represented by the general formula —$A^1$—O—($A^2$—O)q-$R^{29}$ (herein, $R^{29}$ is a hydrogen atom or an alkyl group containing 1 to 30 carbon atoms, $A^1$ is an alkylene group containing 1 to 5 carbon atoms and $A^2$ is an alkylene group containing 1 to 4 carbon atoms, the latter two may be the same or different and may be arranged either blockwies or randomly, and q represents 0 or an integer of 1 to 100), for example groups represented by the general formula —$(CH_2)_3$—O—$(C_2H_4O)$r$(C_3H_6O)$ s-D (D represents a hydrogen atom or an alkyl group containing 1 to 20 carbon atoms and r and s each represents an integer not less than 0 so as to give a sum r+s=1 to 100). a and b each is an integer of 1 to 10,000.

(B2-6) Amino-modified silicones

In these, at least one of $R^{18}$, $R^{19}$, $R^{20}$ and $R^{21}$ is a —$R^{25}$—NH($R^{26}$NH)uH group-containing group ($R^{25}$ is an alkylene group containing 1 to 5 carbon atoms, $R^{26}$ is an alkylene group containing 1 to 4 carbon atoms and u is an integer of 0 to 3). Each remaining group may be a methyl group, an alkyl group containing 2 to 20 carbon atoms, a phenyl group or an alkoxy group containing 1 to 5 carbon atoms. a and b is an integer of 1 to 10,000.

(B2-7) Carboxy-modified silicones

In these, at least one of $R^{18}$, $R^{19}$, $R^{20}$ and $R^{21}$ is a —$R^{27}$—$COOM_{1/m}$ group-containing group [$R^{27}$ is an alkylene group containing 1 to 5 carbon atoms and M and m are defined above referring to the general formula (2)]. Each remaining group may be a methyl group, an alkyl group containing 2 to 20 carbon atoms, a phenyl group or an alkoxy group containing 1 to 5 carbon atoms. a and b each is an integer of 1 to 10,000.

Referring to (B2-1) to (B2-7), the alkyl group containing 2 to 20 carbon atoms may be straight or branched and includes ethyl, n- and i-propyl, butyl, pentyl, hexyl, heptyl, octyl, nonyl, decyl, undecyl, dodecyl, tridecyl, tetradecyl, pentadecyl, hexadecyl, hepatadecyl, octadecyl, 2-ethyldecyl and the like groups.

The alkoxy group containing 1 to 5 carbon atoms includes methoxy, ethoxy, n- and i-propoxy, butoxy and the like groups.

The alkylene group containing 1 to 4 carbon atoms includes those mentioned above referring to $R^4$ and the alkylene group containing 5 carbon atoms includes 1,2-, 1,3-, 1,4-, 2,3- and 2,4-pentylene groups.

The Mw of (B2) is generally 400 to 50,000, preferably 500 to 20,000, more preferably 600 to 10,000.

Preferred among (B2) are (B2-1), (B2-5) and (B2-6), more preferably polydimethylsiloxane among (B2-1), polyether-modified silicones among (B2-5) and amino-modified silicones among (B2-6), still more preferably polydimethylsiloxanes.

(B3) Hydrocarbon lubricants

As (B3), there may be mentioned, for example, mineral oils and refined oils, hydrogenated and/or cracked oils derived therefrom, each having a viscosity at 25° C. of 1 to 1,000 $mm^2/s$.

Preferred among these are mineral oils, in particular refined oils derived therefrom, having a viscosity at 25° C. of 2 to 100 (more preferably 3 to 50) $mm^2/s$.

(B4) Alcohol lubricants

As (B4), there may be mentioned monohydric or dihydric or more polyhydric straight or branched aliphatic, aromatic or alicyclic alcohols containing 8 to 30 carbon atoms and mixture of two or more of them. Specifically, there may be mentioned those containing 8 to 30 carbon atoms among those alcohol components mentioned hereinabove referring to the polymers obtainable by polycondensation among (B1-1).

Preferred among these are straight or branched aliphatic monohydric alcohols containing 8 to 24 carbon atoms, in particular branched, saturated aliphatic monohydric alcohols containing 12 to 18 carbon atoms.

(B5) Carboxylic acid lubricants

As (B5), there may be mentioned straight or branched aliphatic monocarboxylic acids containing 8 to 30 carbon atoms and mixtures of two or more of them. Specifically, there may be mentioned those containing 8 to 30 carbon atoms among those mentioned below under (B6).

Preferred among them are straight or branched aliphatic monocarboxylic acids containing 8 to 24 carbon atoms, in particular branched aliphatic monocarboxylic acids containing 12 to 18 carbon atoms.

(B6) Carboxylic acid ester lubricants

As (B6), there may be mentioned, for example, esters from one or more alcohol components (compounds selected from the group consisting of alcohols and polyether mono- or poly-ols) and one or more carboxylic acid components (compounds selected from among aliphatic carboxylic acids, aromatic carboxylic acids, hydroxy carboxylic acids and lactones); esters from an alcohol component and/or carboxylic acid component and a lactone or hydroxy carboxylic acid; animal oils such as sperm oil; vegetable oils such as rapeseed oil, sunflower oil and palm oil, etc.

Usable as the alcohol components are the same alcohol components as mentioned above referring to the polymers obtainable by polycondensation among (B1-1).

The aliphatic carboxylic acids include $C_{1-30}$ straight or branched, saturated or unsaturated aliphatic monocarboxylic acids, for example formic acid, acetic acid, propionic acid, butyric acid, isobutyric acid, valeric acid, caproic acid, enanthic acid, octanoic acid, decanoic acid, dodecanoic acid, tridecanoic acid, hexadecanoic acid, heptadecanoic acid, octadecanoic acid, oleic acid, eicosanoic acid, 2-ethylhexanoic acid, isooctadecanoic acid, etc.; $C_{2-30}$ straight or branched aliphatic polycarboxylic acids, for example dicarboxylic acids (oxalic acid, malonic acid, succinic acid, adipic acid, maleic acid, etc.), and the like.

The aromatic carboxylic acids include $C_{7-30}$ aromatic monocarboxylic acids, for example benzoic acid, naphthalenecarboxylic acid, etc.; and $C_{8-30}$ aromatic polycarboxylic acids, for example dicarboxylic acids [isophthalic acid, terephthalic acid, 2,6-naphtalenedicarboxylic acid, biphenyldicarboxylic acid (2,2'-, 3,3'- and/or 2,7-form), etc.], tricarboxylic acids (trimellitic acid etc.), and the like.

The hydroxy carboxylic acid includes $C_{2-20}$ aliphatic hydroxy acids [hydroxy monocarboxylic acids (glycolic acid, lactic acid, hydroxybutyric acid, hydroxycaproic acid, licinolic acid, hydroxystearic acid, etc.) and hydroxy polycarboxylic acids (malic acid, tartaric acid, citric acid, etc.)]; and $C_{7-30}$ aromatic hydroxy acids, such as salicylic acid, p-hydroxybenzoic acid and the like.

The lactone includes $C_{3-30}$ lactones, such as γ-butyrolactone and ε-caprolactone.

As specific examples of (B6), there may be mentioned, for example, 2-ethylhexyl palmitate, oleyl oleate, diisostearyl adipate, neopentyl glycol dioleate, trimethylolpropane trilaurate, sorbitan monooleate and bisphenol A—PO (2 moles)-EO (2 moles) adduct dilaurate, etc.

Some of these esters can also serve as emulsifiers in using the spin finish of this invention as a water emulsion. Specifically, there may be mentioned polyoxyalkylene ester type emulsifiers, for example alkyl ether esters composed of a $C_{4-32}$ higher alcohol-EO (1 to 10 moles) adduct and a $C_{8-30}$ fatty acid [lauryl alcohol-EO (3 moles) adduct laurate, isostearyl alcohol-EO (5 moles) adduct adipate, etc.], $C_{2-6}$ polyhydric alcohol $C_{8-30}$ fatty acid ester-$C_{2-4}$ AO adducts (the number of moles added being 1 to 200, for instance) [hydrogenated castor oil-EO (25 moles) adduct, sorbitan trioleate-EO (20 moles) adduct, etc.], etc.

(B7) Polyether Lubricants

As (B7), there may be mentioned, for example, one or more polyether mono- or poly-ols [those alcohol components mentioned hereinabove referring to the polymers obtainable by polycondensation among (B1-1)] and derivatives thereof.

In cases where the polyether mono- or poly-ols are (co)polymers resulting from addition of $C_{2-4}$ AO, and EO and another AO are copolymerized, the content of EO based on the whole AO weight is preferably 5 to 90% by weight, more preferably 10 to 85% by weight, still more preferably 20 to 80% by weight. The mode of addition in the copolymerization may be either random addition or block addition.

As the derivatives of the above AO (co)polymers, there may be mentioned products resulting from alkoxylation of a terminal hydroxyl group with an alkyl halide containing 1 to 12 carbon atoms (e.g. methyl chloride, ethyl bromide, butyl chloride, undecyl bromide, and the like), products resulting from dimerization with a dihaloalkane containing 1 to 12 carbon atoms (e.g. dichloromethane, dibromoethane, dibromodecane), products resulting from urethane formation using an aliphatic, alicyclic or aromatic mono- or di-isocyanate [any of those mentioned hereinabove as raw materials for the urethane polymers obtainable by polyaddition among (B1-1), for example HDI, cyclohexyl isocyanate, phenyl isocyanate, and the like], etc.

The Mw of (B7) is generally 400 to 20,000, preferably 800 to 15,000, more preferably 1,000 to 10,000.

The pour point of (B7) is generally not higher than 40° C., preferably not higher than 30° C., more preferably not higher than 20° C.

The viscosity of (B7) at 25° C. is generally 5 to 1,000 $mm^2/s$, preferably 8 to 700 $mm^2/s$, more preferably 10 to 300 $mm^2/s$.

As specific examples of (B7), there may be mentioned, for example, those alcohol components mentioned hereinabove referring to the polymers obtainable by polycondensation among (B1-1), dimethyl etherified [trimethyloipropane-(PO/EO) block adduct (EO/PO=20/80%, Mw=5,000)], [pentaerythritol-(EO/PO) random adduct (EO/PO=50/50%, Mw=3,000)] dicaprylate, [butanol-(EO/PO) random adduct (EO/PO=50/50%, Mw=800)] dimerized with dichloromethane, [butanol-(EO/PO) random adduct (EO/PO=50/50%, Mw=800)] reacted with HDI for urethane formation, and the like.

Some of these polyethers can also serve as emulsifiers in using the spin finish of this invention as an water emulsion. Specifically, there may be mentioned $C_{1-32}$ higher alcohol-$C_{2-4}$ AO adducts (the number of moles added is 1 to 100, for instance) [butanol-EO/PO random adducts (a number average molecular weight is 500 to 10,000 as determined by GPC), octyl alcohol-EO and/or PO adducts (a number average molecular weight is 300 to 10,000 as determined by GPC), stearyl alcohol-EO and/or PO adducts (a number average molecular weight is of 500 to 10,000 as determined by GPC), etc.] etc.

Preferred among these (B) in the practice of the first aspect of the invention are (B2), (B3) and (B4) and combinations of these, in particular combinations of (B2) and (B3) [e.g. the weight ratio of (B2)/(B3) is 1/99 to 99/1, preferably 10/90 to 90/10].

In the practice of the second aspect of the invention, in particular when (A3) is mainly used as (A), (B1) and combinations of (B1) and another base oil [in particular (B2) and/or (B3)] are preferred. The weight ratio between (B1) and the total of (B2) to (B7), namely (B1)/[(B2) to (B7)], is more preferably 100/0 to 1/99, still more preferably 80/20 to 20/80.

The content of (B1) in the spin finish according to the second aspect of the invention is preferably 0.1 to 90% by weight, more preferably 0.5 to 85% by weight, still more preferably 1 to 80% by weight, based on the whole spin finish (nonvolatile matter). When it is not less than 0.1% by weight, sufficient anti-tackiness properties are produced and, when it is not higher than 90% by weight, the viscosity of the spin finish as a whole is within an appropriate range, hence such a problem as yarn breaking hardly arises. The total content of (B2) to (B7) is preferably 0 to 99% by weight, more preferably 1 to 95% by weight, still more preferably 20 to 80% by weight, based on the whole spin finish (nonvolatile matter).

Preferred as (B) are those each singly having a viscosity at 25° C. of 3 to 2,000 $mm^2/s$. When the viscosity at 25° C. is not less than 3 $mm^2/s$, the volatility is low and the oil can easily stick to yarns and, when it is not higher than 2,000 $mm^2/s$, the viscosity of the whole spin finish can be controlled with ease.

The total content of (B) in the spin finish according to the first and second aspects of the invention is preferably at least not less than 70% by weight, more preferably at least not less than 75% by weight, still more preferably at least not less than 80% by weight, based on the whole spin finish (nonvolatile matter).

The total content of (A) and (B) in the spin finish according to the first and second aspects of the invention is preferably at least not less than 80% by weight, more preferably not less than 85% by weight, still more preferably at least not less than 90% by weight, based on the whole nonvolatile matter weight.

In the spin finish for elastic fibers according to the first and second aspects of the invention, there may further be incorporated, if necessary, an anti-tackiness agent at an addition level at which the performances of the spin finish of the invention will not be impaired. By the addition, the anti-tackiness effect can be increased.

As the anti-tackiness agent, there may be mentioned, for example, fine mineral solid particles, higher fatty acid ($C_{5-30}$) metal salt powders, silicones which are solid at ordinary temperature, waxes which are solid at ordinary temperature, and combinations of two or more of these. The phrase "solid at ordinary temperature" means that it is solid at 25° C.

The fine mineral solid particles include talc, silica, colloidal alumina and the like.

The higher fatty acid ($C_{5-30}$) metal salt powders include divalent or trivalent metal salts [alkaline earth metal salts (calcium salt, magnesium salt, etc.), aluminum salts, etc.] of higher fatty acids containing 5 to 30 (preferably 10 to 20) carbon atoms, etc. As specific examples of the above higher fatty acid, there may be mentioned the ones containing not less than 5 carbon atoms among those mentioned specifically hereinabove referring to the $C_{1-30}$ fatty acid constituting $R^5$. Preferred among these are magnesium stearate, calcium stearate and aluminum stearate.

As the silicones which are solid at ordinary temperature, there may be mentioned silicone resins, and the like. The silicone resins include, for example, solid polymers having a highly branched three-dimensional structure (those described in Silicone Handbook (Kunio Ito (ed.), published by Nikkan Kogyo Shimbunsha), pp. 466–515). Preferred among these are methylsilicone resins having a Mw of 1,000 to 100,000 and amino-modified organopolysiloxane resins having a Mw of 1,000 to 100,000. More preferred are methylsilicone resins having a Mw of 1,500 to 30,000.

As the waxes which are solid at ordinary temperature, there may be mentioned paraffin ($C_{18-70}$), polyethylene (Mw=300 to 100,000) and the like.

Further, nonionic surfactants (e.g. those described in U.S. Pat. Nos. 4,331,447 and 3,929,678) also have a function as an anti-tackiness agent. Some nonionic surfactants are effective as emulsifiers in using said spin finish in the form of a water emulsion.

The components generally used in the spin finish, such as antioxidants (hindered phenols, hindered amines, etc.), ultraviolet absorbers and the like, may further be incorporated.

As for the level of addition of these components, it is generally 0 to 12% by weight, preferably 0.1 to 10% by weight, based on the whole spin finish, in the case of the higher fatty acid metal salt powders, of silicones which are solid at ordinary temperature and of nonionic surfactants not belonging to the above-mentioned (B) and, in the case of other components, it is generally 0 to 3% by weight in total. The total level of addition of these components is generally 0 to 17% by weight, preferably 0.1 to 15% by weight.

The third aspect of the present invention is particularly related to a spin finish for elastic fibers showing good storage stability when a solid metallic soap is suspended therein.

The spin finish according to the third aspect of the invention contains, as an essential component thereof, among a quaternary ammonium salt type surfactant represented by the above general formula (4), namely, among (A2-1), one (A2-11) in which an organic acid-modified silicone (g) is used as the anion $Q^-$-forming acid QH. The preferred composition of cation moiety is the same as mentioned hereinabove referring to (A2-1).

In the spin finish according to the third aspect of the invention, the base oil (B) is used for the purpose of providing smoothness. As (B), as far as those are generally used as a base oil in the spin finish for elastic fibers, without any particular restriction, there may be mentioned the above-mentioned (B1) to (B7) [exclusive of (B2-4), (B2-5) and (B2-6), however], etc. Preferred are polyorganosiloxanes, hydrocarbon lubricants and combinations of these.

The polyorganosiloxanes preferably have a viscosity of 1 to 1,000 $mm^2/s$ as determined on an Ubbellohde viscometer at 25° C. and include the above-mentioned polydimethylsiloxane, methylphenylpolysiloxane (B2-1) and alkyl-modified silicones (B2-3). Preferred among polyorganosiloxanes are polydimethylsiloxanes having a viscosity at 25° C. of 3 to 100 $mm^2/s$. As the hydrocarbon lubricants, there may be mentioned the above-mentioned (B3), and preferred ones are the same as mentioned above.

The polyorganosiloxanes and hydrocarbon lubricants may be used as (B) either singly or in combination. In the case of combined use, the polyorganosiloxane/hydrocarbon lubricant weight ratio is preferably 100/0 to 25/75, more preferably 100/0 to 45/55.

In the spin finish according to the third aspect of the invention, a higher fatty acid ($C_{5-30}$) metal salt powder (C) is used for the purpose of providing anti-tackiness properties. Usable as (C) are those higher fatty acid ($C_{5-30}$) metal salt powders mentioned above as anti-tackiness agents to be optionally added to the first and second aspects of the invention.

For obtaining good smoothness and anti-tackiness properties, the content of the base oil (B) in the spin finish for elastic fibers according to the third aspect of the invention is generally not less than 70% by weight, preferably 75 to 99% by weight, more preferably 80 to 98% by weight, based on the whole spin finish (nonvolatile matter).

The content of the quaternary ammonium salt (A2-11) is generally 0.01 to 10% by weight, preferably 0.01 to 7% by weight, more preferably 0.02 to 5% by weight. When it is not less than 0.01% by weight, the sedimentation preventing effect is good and, when it is not more than 10% by weight, the viscosity is low, hence it is easy to handle.

The content of (C) is generally 0.01 to 12% by weight, preferably 0.1 to 10% by weight, more preferably 0.2 to 5% by weight. When it is not less than 0.01% by weight, sufficient anti-tackiness properties can be produced and, when it is not higher than 12% by weight, the scum formation in the processing processes is slight.

The spin finish according to the third aspect of the invention may contain, if necessary, more than one additives selected from among antistatic agents (D), softening agents (E) and anti-tackiness agents (F) other than (C).

As the antistatic agents (D), there may be mentioned, for example, the above-mentioned anionic surfactants (A3), amphoteric surfactants (A1) and cationic surfactants (A2) other than (A2-11), such as described in U.S. Pat. Nos. 4,331,447 and 3,929,678.

Preferred as (D) are amphoteric surfactants (A1), more preferably (A1-1).

The content of (D) in the spin finish (nonvolatile matter) for elastic fibers according to the third aspect of the invention is preferably not more than 20% by weight, more preferably 0.01 to 10% by weight, based on the whole spin finish (nonvolatile matter), so that sufficient antistatic properties and an appropriate viscosity allowing no yarn breaking or the like may be given to the spin finish.

As the softening agents (E), there may be mentioned epoxy-modifiedsilicones (E1) and amino-modifiedsilicones (E2), etc.

The Mw of (E) as determined by GPC is preferably 500 to 100,000, more preferably 1,000 to 20,000.

As the epoxy-modified silicones (E1), there may be mentioned those specifically mentioned hereinabove as (B2-4)

As the amino-modified silicones (E2), there may be mentioned those specifically mentioned hereinabove as (B2-6)

Among these, amino-modified silicones (E2) are preferred and amino-modified silicones having an Mw of 500 to 20,000 are more preferred.

As the anti-tackiness agents (F) other than (C), there may be mentioned polyether-modified silicones (F1), silicone resins (F2) and other anti-tackiness agents (F3).

As the polyether-modified silicones (F1), there may be mentioned those specifically mentioned hereinabove referring to (B2-5).

As the silicone resins (F2), there may be mentioned those specifically mentioned hereinabove referring to those silicones which are solid at ordinary temperature and are to be used as anti-tackiness agents in the practice of the first and second aspects of the invention.

As the other anti-tackiness agents (F3), there may be mentioned, for example, the above-mentioned fine mineral solid powders and the waxes which are solid at ordinary temperature.

Preferred among these (F) are (F1).

The total content of (E) and/or (F) in the spin finish (nonvolatile matter) according to the third aspect of the invention is not particularly restricted but preferably is not more than 20% by weight, more preferably 0.1 to 10% by weight. These additives can provide elastic fibers with optimal performances when used singly or in combination of several species according to the intended use of the elastic fibers, for example core spun yarn manufacture, covering, air covering, circular knitting, warping, etc.

In the spin finish according to the third aspect of the invention, there may further be incorporated, if necessary, one or more known compatibilizing components [e.g. the above-mentioned nonionic surfactants [other than those belonging to (B)]; higher alcohols such as 2-ethylhexanol and isostearyl alcohol, etc.] at an addition level within the range in which the performances of the spin finish for elastic fibers according to the invention will not be impaired. By incorporating these, it is possible to further improve the storage stability of the spin finish.

Further, components generally used in the spin finish, such as the above-mentioned antioxidants and ultraviolet absorbers, can be incorporated.

As for the level of addition of these components in the spin finish (nonvolatile matter) according to the third aspect of the invention, it is generally 0 to 10% by weight, preferably 0.1 to 7% by weight, in the case of compatibilizing components, and, in the case of antioxidants and of ultraviolet absorbers, it is generally to 3% by weight, preferably 0.1 to 1% by weight, respectively.

For uniform adhesion and roller pick up prevention, the spin finish according to any of the first to third aspects of the invention preferably has a viscosity at 25° C. of 2 to 100 $mm^2/s$.

The viscosity is measured by the following method.

Method of Viscosity Measurement

A 20-g portion of the sample spin finish is placed in an Ubbellohde viscometer and conditioned to 25±0.5° C. in a constant-temperature water bath. After 30 minutes, the viscosity is measured by the Ubbellohde method.

The method of producing each of the spin finishes according to the first to third aspects of the invention is not particularly restricted but includes, for example, the method comprising placing the respective components in a compounding vessel equipped with an ordinary agitating apparatus (e.g. paddle agitator, propeller agitator) and a heating apparatus (e.g. 0 to 200° C.) and mixing them up.

As for the application form of the spin finish, it may be used generally in a water-free condition but, if necessary, it may be used in the form of a water emulsion.

The spin finish in a water-free condition can be used as it is (straight oiling) or in a form diluted with a diluent [organic solvent, low viscosity (less than 1 $mm^2/s$) mineral oil, etc.]. The degree of dilution is not particularly restricted but the spin finish weight [total weight of nonvolatile matter] is preferablyl to 80% by weight, more preferably 5 to 70% by weight, based on the whole weight of the diluted spin finish after dilution.

The organic solvent includes, for example, aliphatic hydrocarbons such as hexane and pentane; ethers such as diethyl ether and dipropyl ether; alcohols such as methanol, ethanol and isopropanol; ketones such as acetone, methyl ethyl ketone and methyl isobutyl ketone; aromatic hydrocarbons such as toluene and xylene; highly polar solvents such as dimethylformamide and dimethyl sulfoxide; and halogenated hydrocarbons such as chloroform and carbon tetrachloride.

The low viscosity mineral oil includes, for example, a liquid paraffin or purified spindle oil having a viscosity at 25° C. of less than 1 $mm^2/s$.

The water emulsion can be prepared by the conventional method of emulsification. For example, it is obtainable by emulsifying the spin finish of the invention in water, if necessary following admixing with an emulsifier.

Usable as the emulsifier are the above-mentioned anionic surfactants (A3), the above-mentioned nonionic surfactants and the like, although no emulsifier is required in certain cases depending on the component species in the spin finish, for example (A) or (B).

In cases where an emulsifier other than the above-mentioned respective components is used, the amount of emulsifier is preferably 0 to 50% based on the whole weight of the spin finish (nonvolatile matter) after incorporation of the emulsifier.

Usable as the emulsifying apparatus are emulsifying vessels equipped with an agitator, ball mills, Gaulin homogenizers, homodisper, bead mills and the like.

The concentration of the emulsion is not particularly restricted but the spin finish weight is preferably 0.01 to 30% by weight, more preferably 0.2 to 20% by weight, based on the whole weight of the emulsion after emulsification.

Each of the spin finishes according to the first to third aspects of the invention can be given to yarns in the process of spinning elastic fibers (e.g. at 200 to 1,200 m/min) in the manner of roller oiling or nozzle oiling, or the like, at an arbitrary site after spinning and before winding up of yarns. The temperature of the spin finish to be supplied is generally 10 to 80° C., preferably 15 to 60° C.

The spin finish of the present invention is given to elastic fibers generally in an amount of 0.1 to 12% (preferably 0.5 to 10, more preferably 1 to 8) by weight based on the nonvolatile matter.

As the elastic fibers to which the spin finish according to the first to third aspects of the invention can be applied, there may be mentioned elastic polyurethane yarns, elastic polyester yarns, elastic polyamide yarns, elastic polycarbonate yarns and the like, and particularly, it can appropriately be used for elastic polyurethane yarns.

The fineness of elastic fibers to which the spin finish of the invention can be applied is not particularly restricted but preferably is 10 to 2,500 dtx, more preferably 11 to 1,870 dtx.

The elastic fibers treated with the spin finish according to the first to third aspects of the invention are made up into final products through processing processes (e.g. air spun yarn process, covering process, air covering process, knitting process, warping process, scouring process, dyeing process, finishing process, etc.).

The elastic fibers can be applied widely to such final products as articles of clothing [e.g. panty hose, socks, inner foundations (brassieres, girdles, bodysuits, etc.), outerwear (jackets, slacks, etc.), sportswear (swimsuits, leotards, ski pants, etc.)] and industrial materials (e.g. paper diapers, belts, etc.).

BEST MODES FOR CARRYING OUT THE INVENTION

The following examples illustrate the present invention in more detail. They are, however, by no means limitative of the scope of the present invention. In the following sentences and tables, "part(s)" means "part(s) by weight (active component)" and "%" means "% by weight".

Examples 1 to 26 and Comparative Examples 1 to 9

Spin finishes for elastic fibers of Examples 1 to 26 and Comparative Examples 1 to 9 were prepared according to the compositions and amounts (parts) given in Tables 1 to 4.

In the process of dry spinning of elastic polyurethane fibers, the spin finish specified in Tables 1 to 4 were each given to the fibers by the roller oiling technique so that the oil pick-up is 6% based on the filament weight. The fibers were wound up on a cheese at 600 m/min. The elastic polyurethane fibers thus obtained had a fineness of 40 D.

Further, the spin finishes according to the first aspect of the invention as used in Examples 1 to 17 (some serving also as examples of the second aspect of the invention), the spin finishes according to the second aspect of the invention as used in Examples 18 to 21 and in Comparative Examples 1 to 6 were measured for surface tension and volume resistivity by the methods mentioned above and subjected to tackiness testing and antistatic property testing by the test methods mentioned below. The spin finishes according to the third aspect of the invention as used in Examples 22 to 26 and Comparative Examples 7 to 9 were subjected to tackiness testing and storage stability testing by the test methods mentioned below. The evaluation results are shown in Tables 1 and 2 (first aspect of the invention), Table 3 (second aspect of the invention) and Table 4 (third aspect of the invention) additionally.

<Test Methods>

(1) Tackiness Testing

The fibers wound on cheeses are subjected to one week of aging at 25° C. and then submitted to a variable ratio delivery/winding apparatus (in which the ratio between the delivery rate and winding rate can be varied). The yarns were delivered at a rate of 50 m/min and the minimum rate ratio at which the fibers can be wound up without being caught up due to tacking is determined. A ratio not more than 1.3 is preferred.

(2) Antistatic Property Testing

The fibers aged under the same conditions as in tackiness testing are used and subjected to warping at a warping rate of 600 m/min using a Kaar Mayer model DSE-H warping machine and the static electricity generated is measured. A value not more than 0.5 kv is preferred.

(3) Storage Stability Testing of the Spin Finish

A 100-g portion of each spin finishes prepared is placed in a 145-ml glass bottle and allowed to stand in a thermostat maintained at 5° C., 25° C. or 50° C. for 30 days. The spin finish is then evaluated for appearance by visual observation. The appearance is compared with the appearance of the spin finish just after preparation. The evaluation criteria are as follows.

Evaluation Criteria

○: No change;

X: Separation or precipitate formation.

Each component shown in Tables 1 to 4 in terms of symbols are as follows.

<Surfactants>

A1-①: Lauryldimethylbetaine

A1-②: Lauramidopropyldimethylbetaine

A1-③: Stearamidopropyldimethylbetaine

A1-④: Sodium β-laurylaminopropionate

A1-⑤: Sodium N-lauryl-β-iminodipropionate

A1-⑥: Potassium N-lauryl-β-iminodipropionate

A2-①: Didecyldimethylammonium isostearate

A2-②: Di(didecyldimethylammonium) adipate

A2-③: Didecyldimethylammonium carboxy-modified silicone (X-22-3710; product of Shin-Etsu Chemical) salt A2-④: Didecylmethylamine isostearate A2-⑤: Di(didecylmethylamine) adipate A2-⑥: Didecylmethylamine salt of carboxy-modified silicone (X-22-3710; product of Shin-Etsu Chemical)

A2-⑦: Lauramidopropyldimethylamine salt of carboxy-modified silicone (X-22-3710; product of Shin-Etsu Chemical)

A2-⑧: Didecyldimethylammonium salt of carboxy-modified silicone (X-22-3701E; product of Shin-Etsu Chemical)

A3-①: Sodium salt of carboxymethylated isostearyl alcohol-EO (3 moles) adduct

A3-②: Sodium lauryl phosphate (mixture of monolauryl phosphate and dilauryl phosphate in a mole ratio of 8/2)

<Base Oils>

B1-①: $C_8F_{17}CH_2CH_2OCOCH_2CH(C_3H_6CH_3)C_2H_4CH_3$

B1-②: $C_8F_{17}CH_2CH_2O(C_2H_4O)_3COCH_2CH(C_3H_6CH_3)C_2H_4CH_3$

B1-③: Copolymer of $C_8F_{17}SO_2N(C_3H_7)C_2H_4OH$-EO (5 moles) adduct acrylate (40 mole percent), methanol-EO (15 moles) adduct acrylate (30 mole percent) and MMA (30 mole percent) (fluorine content=21% by weight, Mw=12,000)

B2-①: Polydimethylsiloxane (SH-200 10 CS; product of Toray Dow Corning)

B3-①: Mineral oil (Liquid Paraffin 60S; product of Chuo Kasei)

<Anti-tackiness Agent>

C-①: Magnesium stearate

F-①: Polyether-modified silicone (L-7001; product of Nippon Unicar)

<Softening Agent>

E-①: Amino-modified silicone (KF-8004; product of Shin-Etsu Chemical)

TABLE 1

| | Example | | | | | | | | | |
|---|---|---|---|---|---|---|---|---|---|---|
| | 1 | 2 | 3 | 4 | 5 | 6 | 7 | 8 | 9 | 10 |
| | <Formulation> | | | | | | | | | |
| A1-① | 1.0 | | | | | | | | | |
| A1-② | | 1.0 | | | | | 1.0 | | | |
| A1-③ | | | 1.0 | | | | | | | |
| A1-④ | | | | 1.0 | | | 1.0 | | | |
| A1-⑤ | | | | | 1.0 | | | | | |
| A1-⑥ | | | | | | 1.0 | | | | |
| A2-① | | | | | | | | 1.0 | | |
| A2-② | | | | | | | | | 1.0 | |
| A2-③ | | | | | | | | | | 1.0 |
| A2-④ | | | | | | | | | | |
| A2-⑤ | | | | | | | | | | |
| A2-⑥ | | | | | | | | | | |
| A2-⑦ | | | | | | | | | | |
| A3-① | | | | | | | | | | |
| A3-② | | | | | | | | | | |
| B2-① | 69.0 | 69.0 | 69.0 | 69.0 | 69.0 | 69.0 | 68.0 | 69.0 | 69.0 | 69.0 |
| B3-① | 30.0 | 30.0 | 30.0 | 30.0 | 30.0 | 30.0 | 30.0 | 30.0 | 30.0 | 30.0 |
| C-① | | | | | | | | | | |

TABLE 1-continued

| | Example | | | | | | | | | |
|---|---|---|---|---|---|---|---|---|---|---|
| | 1 | 2 | 3 | 4 | 5 | 6 | 7 | 8 | 9 | 10 |
| <Performance characteristics evaluation> | | | | | | | | | | |
| Surface tension mN/m | 20.8 | 20.5 | 21.1 | 21.0 | 20.8 | 21.1 | 21.3 | 21.0 | 20.8 | 21.1 |
| Volume resistivity (Ω · cm) | $1 \times 10^{11}$ | $5 \times 10^{10}$ | $1 \times 10^{11}$ | $1 \times 10^{11}$ | $3 \times 10^{10}$ | $3 \times 10^{10}$ | $1 \times 10^{10}$ | $4 \times 10^{11}$ | $1 \times 10^{11}$ | $3 \times 10^{10}$ |
| Tackiness (g) | 0.9 | 0.9 | 0.9 | 0.9 | 0.9 | 0.9 | 0.8 | 0.9 | 0.9 | 0.9 |
| Antistatic property (KV) | 0.1 | 0.1 | 0.1 | 0.1 | 0.1 | 0.1 | 0.1 | 0.1 | 0.1 | 0.1 |

TABLE 2

| | Example | | | | | | | Comparative Example | | |
|---|---|---|---|---|---|---|---|---|---|---|
| | 11 | 12 | 13 | 14 | 15 | 16 | 17 | 1 | 2 | 3 |
| <Formulation> | | | | | | | | | | |
| A1-1 | | | | | | | | | | |
| A1-2 | | | | | 1.0 | 1.0 | | | | |
| A1-3 | | | | | | | | | | |
| A1-4 | | | | | | | 1.0 | | | |
| A1-5 | | | | | | | | | | |
| A1-6 | | | | | | | | | | |
| A2-1 | | | | | | | | | | |
| A2-2 | | | | 1.0 | | | | | | |
| A2-3 | | | | | | 1.0 | 1.0 | | | |
| A2-4 | 1.0 | | | 1.0 | | | | | | |
| A2-5 | | 1.0 | | | | | | | | |
| A2-6 | | | 1.0 | | | | | | | |
| A2-7 | | | | | 1.0 | | | | | |
| A3-1 | | | | | | 2.0 | 2.0 | | | |
| A3-2 | | | | | | | | | 1.0 | 1.0 |
| B2-1 | 69.0 | 69.0 | 69.0 | 68.0 | 49.0 | 48.0 | 48.0 | 100 | 99.0 | 69.0 |
| B3-1 | 30.0 | 30.0 | 30.0 | 30.0 | 47.0 | 47.0 | 47.0 | | | 30.0 |
| C-1 | | | | | 2.0 | 1.0 | 1.0 | | | |
| <Performance characteristics evaluation> | | | | | | | | | | |
| Surface tension mN/m | 20.9 | 21.1 | 21.0 | 21.3 | 20.2 | 20.3 | 20.3 | 18.6 | 19.5 | 21.8 |
| Volume resistivity (Ω · cm) | $1 \times 10^{11}$ | $1 \times 10^{11}$ | $3 \times 10^{10}$ | $2 \times 10^{10}$ | $2 \times 10^{11}$ | $1 \times 10^{11}$ | $1 \times 10^{11}$ | $5 \times 10^{14}$ | $2 \times 10^{14}$ | $5 \times 10^{13}$ |
| Tackiness (g) | 0.9 | 0.9 | 0.9 | 0.8 | 0.9 | 0.9 | 0.9 | 1.5 | 1.5 | 1.7 |
| Antistatic property (KV) | 0.1 | 0.1 | 0.1 | 0.1 | 0.1 | 0.1 | 0.1 | 3.0 | 1.0 | 1.0 |

TABLE 3

| | Example | | | | Comparative Example | | | |
|---|---|---|---|---|---|---|---|---|
| | 18 | 19 | 20 | 21 | 1 | 4 | 5 | 6 |
| <Formulation> | | | | | | | | |
| A1-2 | | | | 5.0 | | | | |
| A3-1 | 15.0 | 10.0 | 15.0 | 10.0 | | | 15.0 | 15.0 |
| B1-1 | 60.0 | | 50.0 | 60.0 | | 100 | | |
| B1-2 | | 50.0 | | | | | | |
| B1-3 | | | 5.0 | | | | | |
| B2-1 | 25.0 | | 15.0 | 25.0 | 100 | | 85.0 | |
| B3-1 | | 40.0 | 15.0 | | | | | 85.0 |
| <Performance characteristics evaluation> | | | | | | | | |
| Surface tension (mN/m) | 17.5 | 18.5 | 18.0 | 17.8 | 18.6 | 18.5 | 23.0 | 32.0 |
| Volume resistivity (Ω · cm) | $1 \times 10^{9}$ | $2 \times 10^{9}$ | $1 \times 10^{9}$ | $1 \times 10^{9}$ | $5 \times 10^{14}$ | $1 \times 10^{15}$ | $2 \times 10^{10}$ | $2 \times 10^{10}$ |
| $1 \times 10^{(-24S+61)}$ | $1 \times 10^{19}$ | $4 \times 10^{16}$ | $6 \times 10^{17}$ | $2 \times 10^{18}$ | $2 \times 10^{16}$ | $4 \times 10^{16}$ | $6 \times 10^{5}$ | $2 \times 10^{-16}$ |

TABLE 3-continued

| | Example | | | | Comparative Example | | | |
|---|---|---|---|---|---|---|---|---|
| | 18 | 19 | 20 | 21 | 1 | 4 | 5 | 6 |
| Tackiness (g) | 1.1 | 1.2 | 1.2 | 1.1 | 1.5 | 2.0 | 2.0 | 3.0 |
| Antistatic property (KV) | 0.1 | 0.1 | 0.1 | 0.1 | 3.0 | 3.0 | 0.1 | 0.1 |

TABLE 4

| | Example | | | | | Comparative Example | | |
|---|---|---|---|---|---|---|---|---|
| | 22 | 23 | 24 | 25 | 26 | 7 | 8 | 9 |
| <Formulation> | | | | | | | | |
| A2-3 | 0.4 | 0.5 | | | 1.0 | | | |
| A2-8 | | | 1.0 | 1.0 | | | | |
| B2-1 | 97.6 | 95.0 | 95.0 | 94.0 | 96.5 | 65.0 | 65.0 | 65.0 |

TABLE 4-continued

| | Example | | | | | Comparative Example | | |
|---|---|---|---|---|---|---|---|---|
| | 22 | 23 | 24 | 25 | 26 | 7 | 8 | 9 |
| B3-(1) | | | 2.0 | 2.0 | | 33.0 | 32.0 | 34.0 |
| C-(1) | 2.0 | 2.0 | 2.0 | 2.0 | 2.0 | 2.0 | 1.0 | |
| E-(1) | | 0.5 | | 0.5 | | | 1.0 | |
| F-(1) | | 2.0 | | 0.5 | 0.5 | | 1.0 | 1.0 |
| <Performance characteristics evaluation> | | | | | | | | |
| Tackiness (g) | 1.1 | 1.1 | 1.1 | 1.1 | 0.8 | 1.3 | 1.2 | 2.0 |
| Storage stability 5° C. | ○ | ○ | ○ | ○ | ○ | X | X | ○ |
| Storage stability 25° C. | ○ | ○ | ○ | ○ | ○ | X | X | ○ |
| Storage stability 50° C. | ○ | ○ | ○ | ○ | ○ | X | X | ○ |

As is evident from Table 1 to 3, the spin finishes (Examples 1 to 21) having a surface tension and a volume resistivity within the respective ranges specified according to the first or second aspect of the invention are excellent in antistatic property and anti-tackiness property. On the contrary, none of the compositions of Comparative Examples 1 to 6 is excellent in both performances.

Further, as is evident from Table 4, spin finishes (Examples 22 to 26) according to the third aspect of the invention are superior in spin finish storage stability and anti-tackiness property to the spin finishes of Comparative Examples 7 and 8 and superior in anti-tackiness property to the composition of Comparative Example 9.

INDUSTRIAL APPLICABILITY

When the spin finish for elastic fibers according to the invention, which is excellent in antistatic properties, storage stability, anti-tackiness property between yarns and smoothness, is used, elastic fibers can be produced while maintaining the operating efficiency at a stable level throughout the spinning and processing processes.

What is claimed is:

1. A method of treating an elastic fiber which comprises providing an elastic fiber with a spin finish for elastic fibers in a amount of 0.1 to 12% by weight of the elastic fiber, said spin finish comprising an amphoteric surfactant (A1) and/or a cationic surfactant (A2) as well as a base oil (B) and having a surface tension thereof at 25° C. of 14 to 35 mN/m and a volume resistivity thereof at 20° C. of $1\times10^{7}$ to $1\times10^{13}$ Ωcm.

2. The method of treating an elastic fiber according to claim 1, wherein the amphoteric surfactant (A1) comprises not less than one surfactant represented by the following general formula (1), (2) or (3):

(1)

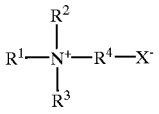

(2)

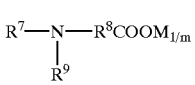

-continued (3)

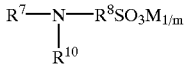

in the formulas, $R^1$, $R^2$ and $R^3$ each independently is a group selected from among an alkyl, alkenyl and hydroxyalkyl group containing 1 to 30 carbon atoms and groups represented by the formula $R^5$—T—$R^6$—, $R^5$ represents the residue of a $C_{1-30}$ fatty acid after removal of the COOH group therefrom $R^6$ represents an alkylene or hydroxyalkylene group containing 1 to 4 carbon atoms and T represents —COO— or —CONH—; $R^4$ is an alkylene or hydroxyalkylene group containing 1 to 4 carbon atoms; X is COO or $SO_3$; $R^7$ is an alkyl, alkenyl or hydroxyalkyl group containing 1 to 30 carbon atoms; $R^8$ is an alkylene or hydroxyalkylene group containing 1 to 4 carbon atoms; $R^9$ is a hydrogen atom or a group represented by the formula —$R^8COOM_{1/m}$; $R_{10}$ is a hydrogen atom or an alkyl or alkenyl group containing 1 to 30 carbon atoms; M is a hydrogen atom or an alkali metal, alkaline earth metal or amine cation and, when M is a plurality of species, they may be the same or different; m represents the valence of M and is 1 or 2.

3. The method of treating an elastic fiber according to claim 1, wherein the cationic surfactant (A2) comprises one or two or more surfactants represented by the following general formula (4) or (5);

(4)

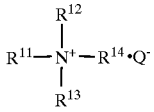

(5)

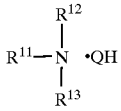

in the formula, $R^{11}$, $R^{12}$ and $R^{13}$ each independently represents a group selected from among alkyl, alkenyl, hydroxyalkyl and polyoxyalkylene group containing 1 to 30 carbon atoms an groups represented by the formula $R^5$—T—$R^6$—, $R^5$ represents the residue of a $C_{1-30}$ fatty acid after removal of the COOH group therefrom, $R^6$ represents an alkylene or hydroxyalkylene group containing 1 to 4 carbon atoms and T represents —COO— or —CONH—; $R^{14}$ is an alkyl, alkenyl, hydroxyalkyl or polyoxyalkylene group containing 1 to 30 carbon atoms; any two of $R^{12}$, $R^{13}$ and $R^{14}$, together with N, may combinedly form a heterocyclic ring; Q represents an inorganic or organic acid anion and QH represents an inorganic or organic acid.

4. A method of treating an elastic fiber which comprises providing an elastic fiber with a spin finish for elastic fibers in an amount 0.1 to 12% by weight of the elastic fiber, said spin finish comprising an ionic surfactant (A) and a base oil (B) and having a surface tension (S) thereof at 25° C. of 14 to 22.5 mN/m and a volume resistivity (ρ) thereof at 20° C. of $1\times10^{7}$ to $1\times10^{13}$ Ω cm, ρ and S satisfying the following relation [1]: $\rho \leqq 1\times10^{(-24S+61)}$ [1].

5. The method of treating an elastic fiber according to claim 4, wherein (A) is one or two or more ionic surfactants selected from the group consisting of amphoteric surfactants (A1), cationic surfactants (A2) and anionic surfactants (A3).

6. The method of treating an elastic fiber according to claim 4, wherein the base oil (B) is not less than one lubricant selected from the group consisting of fluorine-containing lubricants (B1), silicone lubricants (B2), hydrocarbon lubricants (B3), alcohol lubricants (B4), carboxylic acid lubricants (B5), carboxylic acid ester lubricants (B6) and polyether lubricants (B7).

7. The method of treating an elastic fiber according to claim 6, wherein (B1) is one or two or more species selected from the group consisting of polymers (B1-1), surfactants (B1-2) and other esters and/or amides (B1-3).

8. The method of treating an elastic fiber according to claim 4 which comprises one or two or more anti-tackiness agents selected from the group consisting of fine mineral solid particles, higher fatty acid ($C_{5-30}$) metal salt powders, silicones which are solid at ordinary temperature and waxes which are solid at ordinary temperature.

9. The method treating an elastic fiber according to claim 6, wherein the content of (B1) in the spin finish (nonvolatile matter) is 0.1 to 90% by weight.

10. The method of treating an elastic fiber according to claim 4, wherein the content of (A) in the spin finish (nonvolatile matter) is 0.01 to 30% by weight.

11. A method of treating an elastic fiber which comprises providing an elastic fiber with a spin finish for elastic fibers in an amount of 0.1 to 12% by weight of the elastic fiber, said spin finish comprising a quaternary ammonium salt (A2–11) represented by the following general formula (6), a base oil (B) and a higher fatty acid ($C_{5-30}$) metal salt powder (C):

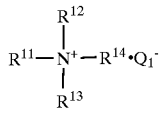

(6)

in the formula, $R^{11}$, $R^{12}$ and $R^{13}$ each independently is a group selected from among an alkyl, alkenyl, hydroxyalkyl and polyoxyalkylene group containing 1 to 30 carbon atoms and groups represented by the formula $R^5$—T—$R^6$—, $R^5$ represents the residue of a $C_{1-30}$ fatty acid after removal of the COOH group therefrom, $R^6$ represents an alkylene or hydroxyalkylene group containing 1 to 4 carbon atoms and T represents —COO— or —CONH—; $R^{14}$ is an alkyl, alkenyl, hydroxyalkyl or polyoxyalkylene group containing 1 to 30 carbon atoms; any two of $R^{12}$, $R^{13}$ and $R^{14}$, together with N, may combinedly form a heterocyclic ring; and $Q_1$ is an organic acid anion derived from an organic acid-modified silicone.

12. The method of treating an elastic fiber according to claim 11, which comprises not less than one additives selected from among antistatic agents (D), softening agents (E) and anti-tackiness agents (F) other than (C).

13. The method of treating an elastic fiber according to claim 11, wherein the content of (A2-11) in the spin finish (nonvolatile matter) is 0.01 to 10% by weight and the content of (C) is 0.01 to 12% by weight and the content of (B) is not less than 70% by weight.

14. The method of treating an elastic fiber according to claim 1, wherein the base oil (B) is not less than one lubricant selected from the group consisting of fluorine-containing lubricants (B1), silicone lubricants (B2), hydrocarbon lubricants (B3), alcohol lubricants (B4), carboxylic acid lubricants (B5), carboxylic acid ester lubricants (B6) and polyether lubricants (B7).

15. The method of treating an elastic fiber according to claim 1 which comprises one or two or more anti-tackiness agents selected from the group consisting of fine mineral solid particles, higher fatty acid ($C_{5-30}$) metal salt powders, silicones which are solid at ordinary temperature and waxes which are solid at ordinary temperature.

16. The method of treating an elastic fiber according to claim 1, wherein the content of (A1) and/or (A2) in the spin finish (nonvolatile matter) is 0.01 to 30% by weight.

* * * * *